US007957676B2

(12) United States Patent
Tanjo et al.

(10) Patent No.: US 7,957,676 B2
(45) **Date of Patent: *Jun. 7, 2011**

(54) DEVELOPMENT DEVICE AND IMAGE FORMING DEVICE

(75) Inventors: Toru Tanjo, Shiojiri (JP); Tsutomu Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/832,525

(22) Filed: Jul. 8, 2010

(65) Prior Publication Data

US 2010/0278562 A1 Nov. 4, 2010

Related U.S. Application Data

(62) Division of application No. 12/196,175, filed on Aug. 21, 2008, now Pat. No. 7,778,576.

(30) Foreign Application Priority Data

Aug. 24, 2007 (JP) ..... 2007-217847
Jun. 4, 2008 (JP) ..... 2008-146632

(51) Int. Cl.
*G03G 15/20* (2006.01)

(52) U.S. Cl. ..... 399/238; 399/57

(58) Field of Classification Search ..... None
See application file for complete search history.

(56) References Cited

U.S. PATENT DOCUMENTS 4,351,604 A * 9/1982 Karasawa et al. ..... 399/232
6,876,822 B2 4/2005 Sasaki et al.
2006/0133852 A1 6/2006 Joo et al.

* cited by examiner

*Primary Examiner* — David M Gray
*Assistant Examiner* — Roy Yi
(74) *Attorney, Agent, or Firm* — DLA Piper LLP (US)

(57) ABSTRACT

A development device includes a developer container reserving a liquid developer containing toner particles and a carrier liquid. A developer supply member supplies a developer supporting member with liquid developer. An agitating member is disposed in the developer container and supplies the developer supply member with the liquid developer. A developer supporting member cleaning member removes liquid developer on the developer supporting member. The developer container includes a first developer holding section having at least one communication section for making liquid developer flow in, a second developer holding section for reserving liquid developer recovered by the developer supporting member cleaning member, and a partition member partitioning between the first and second developer holding sections, and at least one flowing section shifted from the communication section in an axial direction of the agitating member and allowing liquid developer to move between the first and second developer holding sections.

9 Claims, 19 Drawing Sheets

MEASUREMENT FLOWCHART

DEVELOPMENT DEVICE AND IMAGE FORMING DEVICE

CROSS REFERENCE TO RELATED APPLICATIONS

This application is a divisional of application Ser. No. 12/196,175, filed on Aug. 21, 2008, and claims the benefit of priority under 35 USC 119 of Japanese application no. 2007-217847, filed on Aug. 24, 2007, and Japanese application no. 2008-146632, filed on Jun. 4, 2008, all of which are incorporated herein by reference.

BACKGROUND

1. Technical Field

The present invention relates to a development device using a liquid toner having toner dispersed in a carrier liquid, a development method, and an image forming device.

2. Related Art

In the past, there has been a system in which a development device is provided with a first tank including two agitating screws and a doctor blade, a cleaning blade for recovering excess developer on a development roller, a second tank including a recovery screw for recovering excess developer. Replenishment of the developer is performed by supplying developer from an agitation tank provided separately using a pump (see JP-A-2002-287512).

However, since the two agitating screws in the first tank are opposed to each other and rotated in rotational directions reversed to each other to raise a level of the liquid between the agitating screws, thereby supplying developer to an application roller, it becomes difficult to stabilize the elevation of the liquid level when the viscosity of the developer varies due to a variation in the temperature of the developer, and consequently, it becomes difficult to stably supply the application roller with the developer. Further, since replenishment of the developer is performed by supplying developer from the agitation tank provided separately to an upper part of the first tank using the pump, the liquid level jumps up and the concentration of the developer is not stabilized in the replenishment of the developer.

SUMMARY

It is an advantage of some aspects of the invention to provide a development device, a development method, and an image forming device that stably supply developer to a developer supply member.

According to an aspect of the invention, a development device includes a developer container reserving a liquid developer containing toner particles and a carrier liquid, a developer supporting member for supporting the liquid developer, a developer supply member for supplying the developer supporting member with the liquid developer, an agitating member disposed in the developer container and for supplying the developer supply member with the liquid developer, a developer supporting member cleaning member for removing the liquid developer on the developer supporting member. The developer container includes a first developer holding section having at least one communication section for making the liquid developer flow in, a second developer holding section for reserving the liquid developer recovered by the developer supporting member cleaning member, and a partition member for partitioning between the first and second developer holding sections, and having at least one flowing section shifted from the communication section in an axial direction of the agitating member and allowing the liquid developer to move between the first and second developer holding sections. Accordingly, liquid developer can overflow to the second developer holding section side in the case in which liquid developer in the first developer holding section is increased. Thus, the amount of liquid in the first developer holding section is kept constant, thereby keeping the amount of liquid developer supplied to the developer supply member constant, and stabilizing image quality. Further, by shifting the flowing section and the communication section in the axial direction of the agitating member, the liquid developer supplied via the communication section moves in the first developer holding section, thus reducing imbalance in the axial direction of the agitating member.

Further, since the communication section is disposed on a bottom surface of the developer container, the side space can effectively be used.

Further, since the communication section is disposed on the side surface of the developer container, the lower space can effectively be used.

Further, since the flowing sections are disposed on both sides of the communication section in the axial direction of the agitating member, imbalance in the axial direction of the agitating member is reduced.

Further, since the communication section is disposed on one side in the axial direction of the agitating member, and the flowing section is disposed on the other side in the axial direction of the agitating member, imbalance in the axial direction of the agitating member is reduced.

Further, since there are two or more communication sections, a sufficient amount of liquid developer in the first developer holding section is assured.

Further, since the communication sections are disposed on both sides in the axial direction of the agitating member, imbalance in the axial direction of the agitating member is reduced.

Further, since the communication section is disposed on the opposite side of the partition member from a plumb line passing through the rotational center of the agitating member, the agitating member exists between the communication section and the partition. Thus, liquid developer in the first developer holding section is sufficiently agitated. Further, negative pressure is applied to the communication section, thus the liquid developer is automatically suctioned, and the cost and noise is reduced.

Further, since the agitating member includes a first rib section for making liquid developer flow from the communication section side towards the flowing section, and a second rib different from the first rib, the flow of liquid developer inside the first developer holding section is made smooth.

Further, since a boundary section between the first and second rib sections is disposed at a position corresponding to the flowing section, the liquid developer flows to the vicinity of the flowing section, and it becomes easy for the liquid developer to flow from the first developer holding section towards the second developer holding section.

Further, since one of the first rib section, the second rib section, and both of the first and second rib sections include(s) a semicircular spiral rib, manufacturing of the agitating member is easy.

Further, since there is a single agitating member, the agitating member can be manufactured at low cost.

Further, since the second developer holding section includes a transportation member with double spiral pitches, the amount of transportation is increased.

A development method according to another aspect of the invention includes the steps of supplying a liquid developer from a communication section to a first developer holding section, moving the liquid developer in an axial direction of an agitating member in the first developer holding section, making the liquid developer flow from the first developer holding section to a second developer holding section via a flowing section, and reserving the liquid developer recovered by the development supporting member cleaning member. Accordingly, liquid developer can overflow to the second developer holding section side in the case in which liquid developer in the first developer holding section is increased. Thus, the amount of liquid in the first developer holding section is kept constant, thereby keeping the amount of liquid developer supplied to the developer supply member constant, and stabilizing image quality. Further, by shifting the flowing section and the communication section in the axial direction of the agitating member, liquid developer supplied via the communication section moves in the first developer holding section, thereby reducing imbalance in the axial direction of the agitating member.

An image forming device according to still another aspect of the invention includes a developer supporting member for supporting a liquid developer containing toner particles and a carrier liquid, an image supporting member for supporting an image developed by the developer supporting member, a transfer member to which the image on the image supporting member is transferred, a developer container for reserving the liquid developer, a developer supply member for supplying the developer supporting member with the liquid developer, an agitating member disposed in the developer container and for supplying the developer supply member with the liquid developer, a developer supporting member cleaning member for removing the liquid developer on the developer supporting member, and a developer recovery/supply device for recovering the liquid developer from the developer container, and supplying the liquid developer and the carrier liquid, and the developer container includes a first developer holding section to which the liquid developer is supplied from the developer recovery/supply device via a communication section, a second developer holding section for transporting the liquid developer to the developer recovery/supply device, and a partition member for partitioning between the first developer holding section and the second developer holding section, and having at least one flowing section disposed at a position shifted from the communication section in an axial direction of the agitating member and for allowing the liquid developer to move between the first developer holding section and the second developer holding section. Accordingly, an image can be formed using liquid developer with stable concentration, and the image can be formed with preferable image quality.

BRIEF DESCRIPTION OF THE DRAWINGS

The invention will now be described with reference to the accompanying drawings, wherein like numbers reference like elements.

DESCRIPTION OF EXEMPLARY EMBODIMENTS

Figure 1:
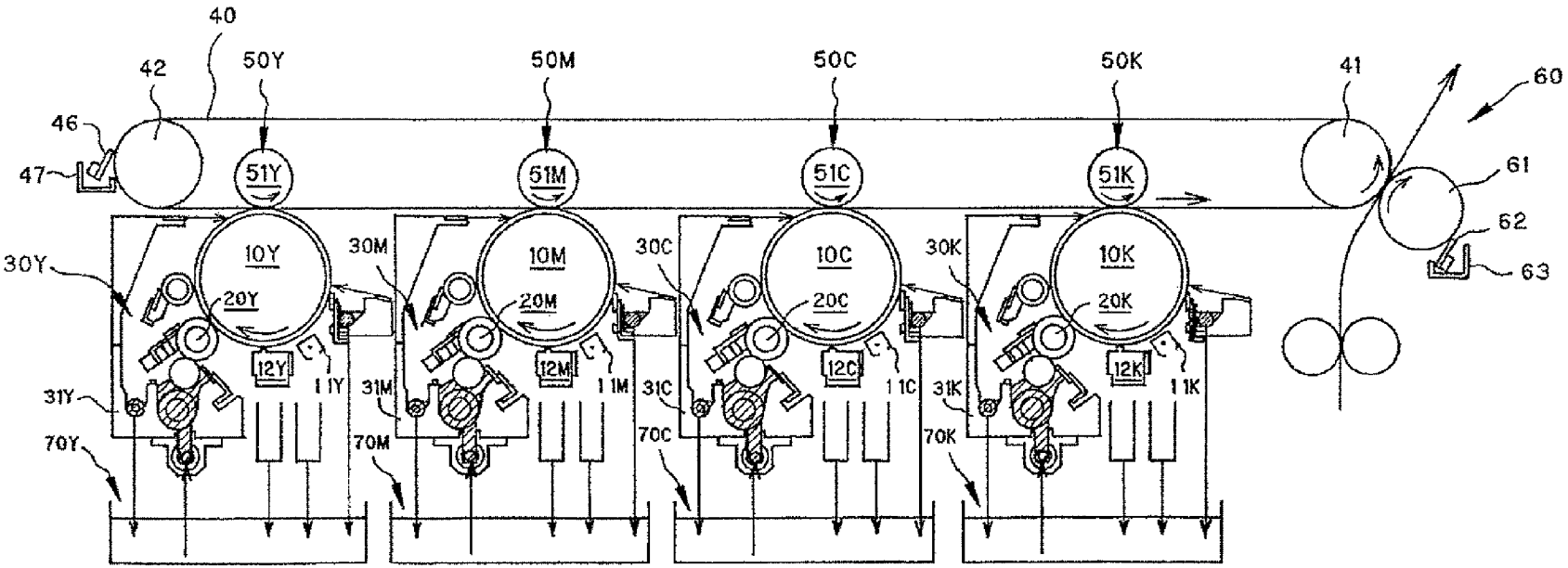
FIG. 1 is a diagram showing an image forming device as an embodiment of the invention.

Embodiments of the invention will hereinafter be explained with reference to the accompanying drawings. FIG. 1 is a diagram showing principal constituents forming the image forming device according to an embodiment of the invention. With respect to the image forming sections for respective colors disposed in the center area of the image forming device, development units 30Y, 30M, 30C, and 30K and developer recovery/supply devices 70Y, 70M, 70C, and 70K are disposed in a lower area of the image forming device, and an intermediate transfer member 40 and a secondary transfer section 60 are disposed in an upper area of the image forming device.

The image forming section is provided with image supporting members 10Y, 10M, 10C, and 10K, charging rollers 11Y, 11M, 11C, and 11K, exposure units 12Y, 12M, 12C, and 12K, and so on. The exposure units 12Y, 12M, 12C, and 12K are each formed of a line head having LEDs arranged and so on, and the image supporting members 10Y, 10M, 10C, and 10K are evenly charged by the charging rollers 11Y, 11M, 11C, and 11K, and then light beams modulated in accordance with image signals input therein are applied on the image supporting members 10Y, 10M, 10C, and 10K thus charged using the exposure units 12Y, 12M, 12C, and 12K, thereby forming electrostatic latent images thereon, respectively.

The development units 30Y, 30M, 30C, and 30K are mainly provided with development rollers 20Y, 20M, 20C, and 20K, developer containers 31Y, 31M, 31C, and 31K for reserving liquid developers of various colors including yellow (Y), magenta (M), cyan (C), and black (K), developer supply rollers 32Y, 32M, 32C, and 32K for supplying the liquid developers of the various colors from the developer containers 31Y, 31M, 31C, and 31K to the development rollers 20Y, 20M, 20C, and 20K, respectively, and developing the electrostatic latent images formed on the image supporting members 10Y, 10M, 10C, and 10K with the liquid developers of the various colors, respectively.

The intermediate transfer member 40 is an endless belt member, wound around a drive roller 41 and a tension roller 42 so as to be stretched across these rollers, and rotationally driven by the drive roller 41 while having contact with the image supporting members 10Y, 10M, 100, and 10K at primary transfer sections 50Y, 50M, 50C, and 50K, respectively. The primary transfer sections 50Y, 50M, 50C, and 50K have primary transfer rollers 51Y, 51M, 51C, and 51K disposed across the intermediate transfer member 40 from the image supporting members 10Y, 10M, 100, and 10K, respectively, and form a full-color toner image by sequentially stacking on the intermediate transfer member 40 the toner images of respective colors on the image supporting members 10Y, 10M, 100, and 10K thus developed at transfer positions at which the intermediate transfer member 40 and the image supporting members 10Y, 10M, 100, and 10K have contact, respectively.

The secondary transfer unit 60 has a secondary transfer roller 61 disposed so as to face the belt driving roller 41 with the intermediate transfer section 40 intervening between them, and has a cleaning device composed mainly of a secondary transfer roller cleaning blade 62 and a developer recovery section 63. In the secondary transfer unit 60, a sheet member such as a form, a film, or cloth is fed and supplied through a sheet member transport path L with a timing by which a full-color toner image formed by stacking colors on the intermediate transfer member 40 or a monochroic toner image reaches a transfer position of the secondary transfer unit 60, and the monochroic toner image or the full-color toner image is secondarily transferred to the sheet member. A fixing unit, not shown, is disposed in front of the sheet member transport path L, for melting the monochroic toner image or the full-color toner image transferred onto the sheet member to be fixed on the recording medium (the sheet member), such as a form, thus terminating the final image forming process on the sheet member.

On the side of the tension roller 42 which applies tension to the intermediate transfer member 40 in cooperation with the belt drive roller 41, there is disposed a cleaning device composed mainly of an intermediate transfer member cleaning blade 46 and a developer recovery section 47 along the periphery of the tension roller 42.

Further, the intermediate transfer member 40 having passed through the secondary transfer unit 60 proceeds to a winding section of the tension roller 42 for executing cleaning on the intermediate transfer member 40 by the intermediate transfer member cleaning blade 46, and then further proceeds towards the primary transfer sections 50.

The developer recovery/supply devices 70Y, 70M, 70C, and 70K control the concentration of liquid developer recovered from the image supporting members 10Y, 10M, 10C, and 10K and the development units 30Y, 30M, 30C, and 30K to supply the developer containers 31Y, 31M, 31C and 31K with developer, respectively.

Figure 2:
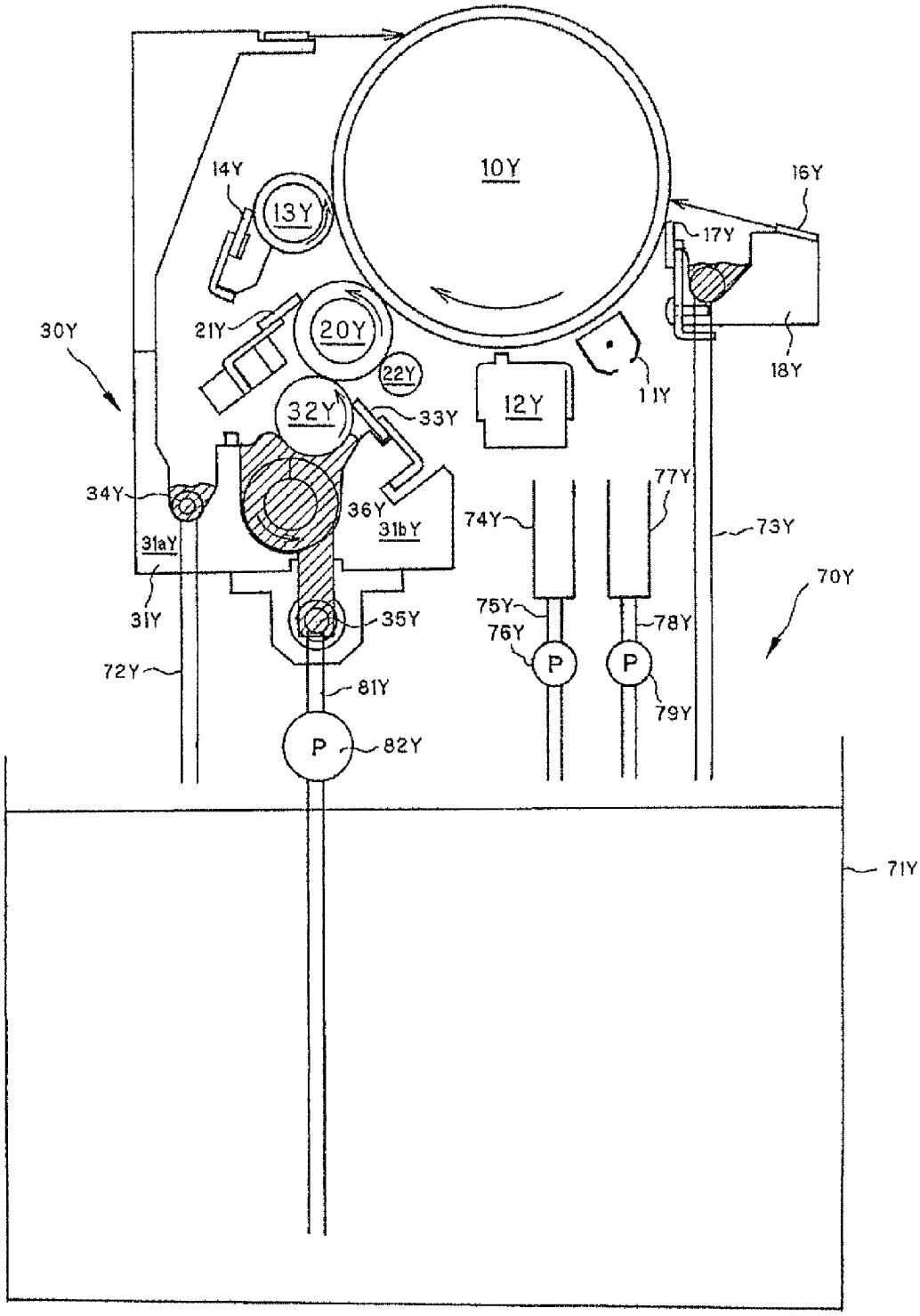
FIG. 2 is a cross-sectional view showing principal constituents of an image forming section and a development unit.
Figure 3:
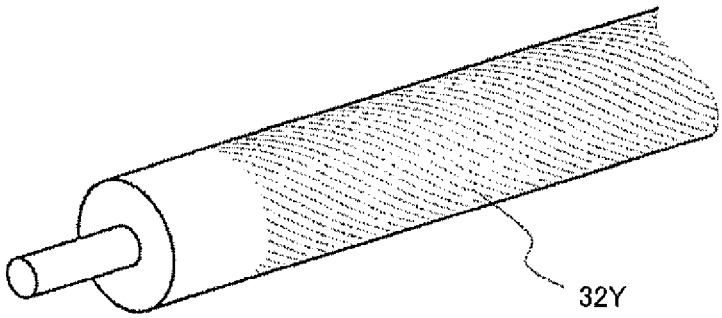
FIG. 3 is a perspective view of a developer supply member.
Figure 4:
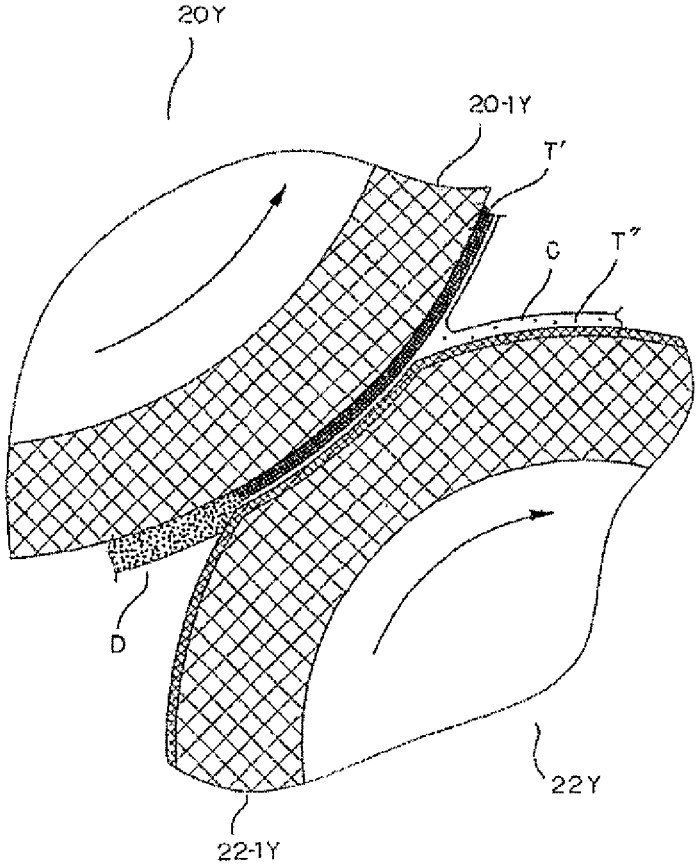
FIG. 4 is a diagram for explaining compression of the developer by a developer compression roller.
Figure 5:
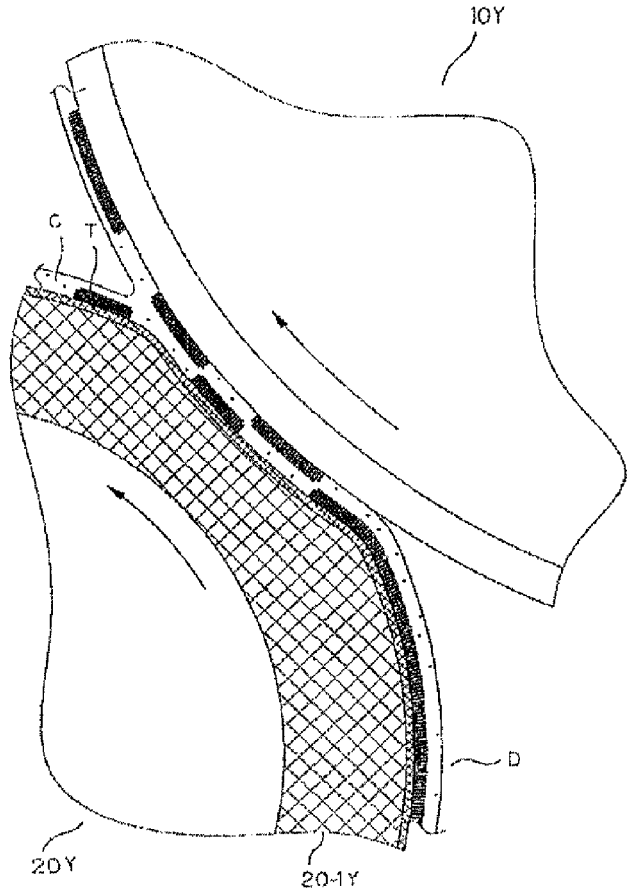
FIG. 5 is a diagram for explaining development by a development roller.
Figure 6:
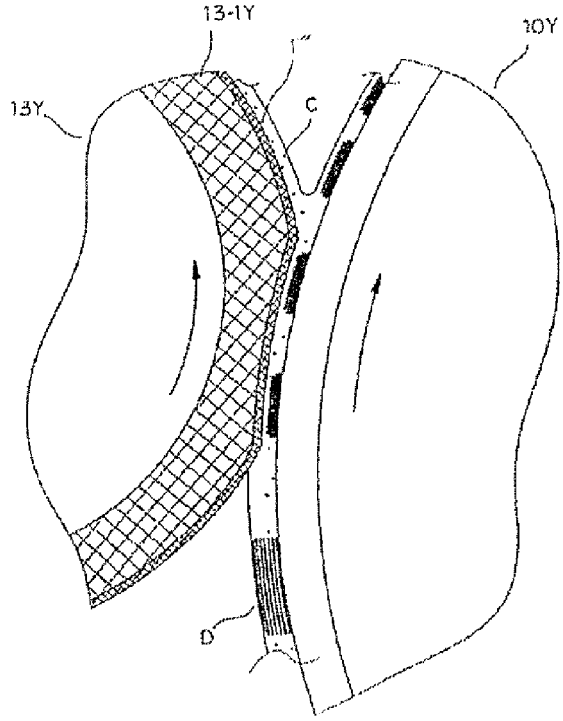
FIG. 6 is a diagram for explaining a squeeze operation using an image supporting member squeezing roller.

The image forming sections and the development units will now be explained. FIG. 2 is a cross-sectional view showing principal constituents of one of the image forming sections and one of the development units. FIG. 3 is a diagram for explaining a developer supply member, FIG. 4 is a diagram for explaining the compression of the developer by a developer compression roller 22Y, FIG. 5 is a diagram for explaining the development by the development roller 20Y, and FIG. 6 is a diagram for explaining a squeeze operation using an image supporting member squeezing roller 13Y. Since the configurations of the image forming sections and the development units for respective colors are substantially the same, only the image forming section and the development unit for yellow (Y) will hereinafter be explained.

The image forming section has a static eliminating device 16Y, a cleaning device composed of an image supporting member cleaning blade 17Y and a developer recovery section 18Y, a charging roller 11Y, an exposure unit 12Y, the development roller 20Y of the development unit 30Y, and a squeeze device composed of the image supporting member squeezing roller 13Y and an image supporting member squeezing roller cleaning blade 14Y disposed along the rotational direction on the outer periphery of the image supporting member 10Y. The development unit 30Y has a cleaning blade 21Y, and the developer supply roller 32Y using an anilox roller disposed on the outer periphery of the development roller 20Y, and the liquid developer agitating paddle 36Y and the developer supply roller 32Y are housed in the liquid developer container 31Y. The primary transfer roller 51Y of the primary transfer section is disposed at a position opposed to the image supporting member 10Y along the intermediate transfer member 40.

The image supporting member 10Y is a photoconductor drum formed of a cylindrical member having a width larger than the width of the development roller 20Y of about 320 mm, and provided with a photoconductor layer formed on the outer peripheral surface thereof, and that rotates, for example, in a clockwise direction as shown in FIG. 2. The photoconductor layer of the image supporting member 10Y is formed of an organic image supporting member, an amorphous silicon image supporting member, or the like. The charging roller 11Y is disposed upstream of a nip section between the image supporting member 10Y and the development roller 20Y in the rotational direction of the image supporting member 10Y, and is provided with a bias voltage of the same polarity as the charging polarity of the developer toner particles, applied from a power supply device not shown, thus charging the image supporting member 10Y. The exposure unit 12Y exposes the surface of the image supporting member 10Y thus charged by the charging roller 11Y at a downstream position of the charging roller 11Y in the rotational direction of the image supporting member 10Y to form a latent image on the image supporting member 10Y.

The development unit 30Y has the developer container 31Y for reserving liquid developer in a condition of dispersing toner in carrier liquid with a weight ratio of roughly 25% the development roller 20Y supporting the liquid developer, the developer supply roller 32Y, a limiting blade 33Y, and the agitating paddle 36Y for agitating the liquid developer to maintain a uniform dispersion condition and supplying the liquid developer to the development roller 20Y, a communication section 35Y for supplying the liquid developer from the liquid developer reservoir 71Y (described later) to the agitating paddle 36Y, the development roller cleaning blade 21Y for cleaning the development roller 20Y, and the recovery screw 34Y for recovering liquid developer scraped out by the development roller cleaning blade 21Y and the image supporting member squeezing roller cleaning blade 14Y and transmitting the liquid developer thus recovered to the liquid developer reservoir 71Y.

The liquid developer contained in the developer container 31Y is not a volatile liquid developer with low concentration (roughly 1-2 wt %), low viscosity, and room-temperature volatility, such as "Isopar" (a trademark of Exxon Mobil Corporation), which has been commonly used in the past, but instead is a nonvolatile liquid developer with high concentration, high viscosity, and room-temperature non-volatility. In other words, the liquid developer in the embodiment of the invention is a high-viscosity (about 30 through 10000 mPa·s) liquid developer having solid matters, which have an average particle diameter of 1 μm and have a colorant such as a pigment dispersed in thermoplastic resin, added to a liquid solvent such as an organic solvent, silicone oil, mineral oil, or edible oil together with a dispersant to have a toner solid content concentration of about 25%.

As shown in FIG. 3, the developer supply roller 32Y is a cylindrical member, which is an anilox roller having an uneven surface with fine uniform spiral grooves formed on the surface thereof so as to easily support developer on the surface thereof, and rotates in a clockwise direction as shown in FIG. 2, for example. The grooves have sizes of about 130 μm in groove pitches and about 30 μm in groove depth. The developer supply roller 32Y supplies liquid developer from the developer container 31Y to the development roller 20Y. The agitating paddle 36Y and the developer supply roller 32Y can have slidable contact with each other, or can be in a separated positional relationship.

The limiting blade 33Y is composed of a rubber section having an elastic blade formed by coating the surface thereof with an elastic member, a polyurethane rubber member having contact with the surface of the developer supply roller 32Y, and so on, and a plate made of metal or the like for supporting the rubber section. Thus, the limiting blade 33Y limits and controls the film thickness and the amount of liquid developer supported and transported by the developer supply roller 32Y formed of the anilox roller, thereby controlling the amount of liquid developer to be supplied to the developer roller 20Y. The rotational direction of the developer supply roller 32Y may instead be the reverse of the direction of the arrow shown in FIG. 2, in which case the limiting blade 33Y is arranged to cope with the change in rotational direction.

The development roller 20Y is a cylindrical member with a width of roughly 320 mm, and rotates counterclockwise around the rotational axis as shown in FIG. 2. The development roller 20Y has an elastic layer such as polyurethane rubber, silicone rubber, or NSR disposed on an outer periphery of an inner core made of metal such as iron. The development roller cleaning blade 21Y is formed of a rubber member having contact with the surface of the development roller 20Y and so on, and is disposed at a downstream position of the development nip section at which the development roller 20Y has contact with the image supporting member 10Y in the rotational direction of the development roller 20Y to remove liquid developer remaining on the development roller 20Y by scraping out the liquid developer.

The developer compression roller 22Y is a cylindrical member having a form of an elastic roller formed by applying a coat of an elastic member 22-1Y similarly to the development roller 20Y as shown in FIG. 4, which is a structure of providing a conductive resin layer or a rubber layer as a surface layer of a metal roller base material, and that rotates clockwise, the reverse direction to the development roller 20Y as shown in FIG. 2, for example. The developer compression roller 22Y increases the charging bias on the surface of the development roller 20Y, and as shown in FIGS. 2 and 4, an electrical field is applied to the developer transported by the development roller 20Y in a developer compression region where the developer compression roller 22Y has slidable contact with the development roller 20Y to form a nip section in a direction from the side of the developer compression roller 22Y to the development roller 20Y. The electrical field applied in the developer compression region can be corona discharge from a corona discharge device, instead of the roller shown in FIG. 2.

As shown in FIG. 4, the developer compression roller 22Y moves the toner T uniformly dispersed in the carrier liquid C to the development roller 20Y side to agglutinate the toner T, thereby forming a so-called developer compression state T', and further, a part of the carrier liquid C and some toner T" not compressed to be in the developer compression state are supported by the developer compression roller 22Y, and scraped out to be removed by the developer compression roller cleaning blade 23Y while the developer compression roller 22Y rotates in the direction of the arrow shown in the drawing, thus combined with the developer in the developer container 31Y to be reused. On the other hand, as shown in FIG. 5, a desired electrical field is applied to the developer D, which is supported by the development roller 20Y and compressed to be in the developer compression state, at the development nip region where the development roller 20Y has contact with the image supporting member 10Y, and the developer D is developed in accordance with the latent image on the image supporting member 10Y. The residual part of the developer D after development is scraped out by the development roller cleaning blade 21Y to be removed therefrom, and is combined with developer in the developer container 31Y to be reused. The combined carrier liquids and toners are not in color-mixed conditions.

The image supporting member squeeze device is disposed at a downstream position of the development roller 20Y so as to be opposed to the image supporting member 10Y, for recovering excess developer of a toner image developed on the image supporting member 10Y, and is composed of the image supporting member squeezing roller 13Y formed of an elastic roller member having a surface coated with an elastic member 13*a*Y and rotating while having slidable contact with the image supporting member 10Y, and the image supporting member squeezing roller cleaning blade 14Y slidably pressed against the image supporting member squeezing roller 13Y to cleaning the surface of the image supporting member squeezing roller 13Y as shown in FIG. 2.

In the primary transfer section 50Y, the developer image thus developed on the image supporting member 10Y is transferred to the intermediate transfer member 40 by the primary transfer roller 51Y. Here, the image supporting member 10Y and the intermediate transfer member 40 are configured to move at a constant velocity. Thus the driving load of rotation and movement is reduced, and the disturbing operation to the overt toner image of the image supporting member 10Y is also reduced.

The developer recovery/supply device 70Y has the liquid developer reservoir 71Y for reserving the liquid developer thus recovered, replenishing a high-concentration developer and carrier liquid from the developer tank 74Y and a carrier liquid tank 77Y, respectively, and adjusting the concentration.

In the present embodiment, liquid developer is recovered from the development unit 30Y and the image supporting member 10Y. Liquid developer recovered by the developer recovery screw 34Y of the development unit 30Y is returned to the liquid developer reservoir 71Y via a development unit recovery path 72Y. Further, liquid developer recovered from the image supporting member 10Y by the cleaning device composed of the image supporting member cleaning blade 17Y and the developer recovery section 18Y is returned to the liquid developer reservoir 71Y via an image supporting member recovery path 73Y.

High-concentration developer is replenished from the developer tank 74Y to the liquid developer reservoir 71Y via a developer replenishment path 75 and the developer pump 76. Carrier liquid is replenished from the carrier liquid tank 77Y to the liquid developer reservoir 71Y via a carrier liquid replenishment path 78Y and the carrier liquid pump 79Y. A structure of using gravity instead of pumps, and performing replenishment by opening and closing valves, can also be adopted.

The liquid developer reserved in the liquid developer reservoir 71Y is supplied to the developer container 31Y via a developer supply path 81Y and a developer supply pump 82Y.

An operation of the image forming device according to an embodiment of the present invention will now be explained. Regarding the image forming sections and the development units, the explanations therefor are presented continuously exemplifying the image forming section and the development unit 30Y for yellow out of the four image forming sections and the four development units.

In the developer container 31Y, toner particles in the liquid developer are provided with a positive charge, and the liquid developer is agitated by the agitating paddle 36Y, and drawn from the developer container 31Y by rotation of the developer supply roller 32Y.

The limiting blade 33Y contacts the surface of the developer supply roller 32Y to leave liquid developer in the grooves of the uneven surface with the anilox pattern formed on the surface of the developer supply roller 32Y and scrapes out other excess liquid developer, thereby limiting the amount of liquid developer supplied to the development roller 20Y. Owing to such a limiting operation, the film thickness of the liquid developer to be applied on the development roller 20Y can be set to be a constant value of about 6 μm. Liquid developer thus scraped out by the limiting blade 331 drops with gravity to be returned to the developer container 31Y, and liquid developer not scraped out by the limiting blade 33Y is contained in the grooves of the uneven surface of the developer supply roller 32Y, and is applied on the surface of the development roller 20Y when the developer supply roller 32Y is pressed against the development roller 20Y.

The development roller 20Y coated with liquid developer by the developer supply roller 32Y contacts the developer compression roller 22Y at a downstream position of the nip section with the developer supply roller 321. A bias voltage of about +400 V is applied to the development roller 20Y, and a bias voltage higher than the bias voltage of the development roller 20Y and having the same polarity as the charge polarity of the toner is applied to the developer compression roller 22Y. For example, a bias voltage of about +600 V is applied to the developer compression roller 22Y. Therefore, as shown in FIG. 4, the toner particles in the liquid developer on the development roller 20Y move to the development roller 20Y side when passing through the nip section with the developer compression roller 22Y. Thus, a condition in which the toner particles are loosely coupled with each other to form a film is achieved, and in the development on the image supporting member 10Y, the toner particles can rapidly be transferred from the development roller 20Y to the image supporting member 10Y, thus the concentration of the image is improved.

The image supporting member 10Y is made of amorphous silicon, and is provided with a charge of about +600 V on the surface thereof at an upstream position of the nip section with the development roller 20Y by the charging roller 11Y. The latent image is then formed on the image supporting member 10Y by the exposure unit 12Y so that the electrical potential of the image area becomes +25 V. At the development nip section formed between the development roller 20Y and the image supporting member 10Y, the toner particles T are selectively moved to the image areas on the image supporting member 10Y in accordance with the electrical field formed by the bias voltage of +400 V applied to the development roller 20Y and the latent image (+25 V in the image areas, +600 V in the non-image areas) as shown in FIG. 5, thus the toner image is formed on the image supporting member 10Y. Since the carrier liquid C does not affected by the electrical field, as shown in FIG. 5, the carrier liquid C is separated at the exit of the development nip section between the development roller 20Y and the image supporting member 10Y, and is attached to both the development roller 20Y and the image supporting member 10Y.

The image supporting member 10Y having passed through the development nip section then passes through the image supporting member squeezing roller 13Y. As shown in FIG. 6, the image supporting member squeezing roller 13Y has a function of recovering excess carrier liquid C and the superfluous toner T", which is fundamentally unnecessary, from the developer D developed on the image supporting member 10Y to increase the toner particle ratio in the overt image. The capacity of recovering the excess carrier liquid C can be set to be a desired recovery capacity by setting a rotational direction of the image supporting member squeezing roller 13Y, and a relative circumferential velocity difference of the surface of the image supporting member squeezing roller 13Y with respect to the circumferential velocity of the image supporting member 10Y, and when rotating them in a counter rotational direction with respect to the rotational direction of the image supporting member 10Y, the recovery capacity increases, further, when setting the velocity difference larger, the recovery capacity also increases, and still further, a synergetic effect thereof is also obtained.

In the present embodiment, as an example, as shown in FIG. 6, the image supporting member squeezing roller 13Y is rotated in the same direction with respect to the image supporting member 10Y at substantially the same circumferential velocity, thus recovering the excess carrier liquid C of about 5-10 weight percent from the developer D thus developed on the image supporting member 10Y, thereby reducing the rotational driving load on both members, and at the same time, reducing the disturbing operation to the overt toner image of the image supporting member 10Y. The excess carrier liquid C and the unnecessary superfluous toner T" recovered by the image supporting member squeezing roller 13Y are returned from the image supporting member squeezing roller 13Y to the developer container 31Y by the operation of the image supporting member squeezing roller cleaning blade 14Y. Since the excess carrier liquid C and the superfluous toner T" thus recovered are recovered from the dedicated and isolated image supporting member 10Y, a color mixture phenomenon is not caused in all of the sections.

Subsequently, the image supporting member 10Y passes through the nip section with the intermediate transfer member 40 in the primary transfer section 50Y, and the primary transfer of the overt toner image to the intermediate transfer member 40 is executed. By applying a voltage of about −200 V with reversed polarity to the charge polarity of the toner particles to the primary transfer roller 51Y, the toner is primary-transferred from the surface of the image supporting member 10Y to the intermediate transfer member 40, and only the carrier liquid remains on the image supporting member 10Y. In the downstream area of the primary transfer section in the rotational direction of the image supporting member 10Y, the electrostatic latent image is removed from the image supporting member 10Y, on which the primary transfer has been executed, by the static eliminating device 16Y formed of an LED or the like, and carrier liquid remaining on the image supporting member 10Y is scraped out by the image supporting member cleaning blade 17Y, and is recovered by the developer recovery section 18Y.

The toner images formed on the respective image supporting members 10 and sequentially primary-transferred to and stacked on the intermediate transfer member 40 then proceed to the secondary transfer unit 60, and enter the nip section between the intermediate transfer member 40 and the secondary transfer roller 61. The nip length on this occasion is set to 3 mm. In the secondary transfer unit 60, a voltage of −1200 V and a voltage of +200 V are applied respectively to the secondary transfer roller 61 and the belt drive roller 41, and thus the toner images on the intermediate transfer member 40 are transferred to a recording medium (sheet member) such as a paper sheet.

However, when trouble in feeding a sheet material such as a paper jam occurs, all of the toner images may not be recovered by being transferred to the secondary transfer roller, and a part thereof may remain on the intermediate transfer member. Even in a normal secondary transfer process, 100% of the toner image on the intermediate transfer member may not be moved to the sheet material by the secondary transfer process, and a remainder of the secondary transfer corresponding to a few percent of the toner image typically occurs. In particular, when trouble in feeding a sheet material such as a paper jam occurs, the toner image contacts the secondary transfer roller 61 in a condition in which no sheet material is interposed therebetween, and is then transferred to the secondary transfer roller 61, which causes stains on the reverse side of the sheet material. In the present embodiment, in order to cope with such an unnecessary toner image, a bias voltage for pressing the toner particles of the liquid developer against the intermediate transfer member, namely, a bias voltage with the same polarity as the charge polarity of the toner particles, is applied to the secondary transfer roller 61 when the transfer is not performed. According to this process, the toner particles of the liquid developer remaining on the intermediate transfer member 40 are pressed against the intermediate transfer member 40 side to be in a compaction state, and at the same time, the carrier liquid is recovered (squeezed) on the secondary transfer roller 61 side, and the cleaning on the intermediate transfer member 40 by the intermediate transfer member cleaning blade 46, and the cleaning of the secondary transfer roller 61 by the secondary transfer roller cleaning blade 62 are performed.

The cleaning device for the intermediate transfer member 40 will now be explained. When trouble in feeding a sheet material such as a paper jam occurs, all of the toner images may not be transferred to the secondary transfer roller 61 to be recovered, and a part thereof may remain on the intermediate transfer member 40. Even in a normal secondary transfer process, 100% of the toner image on the intermediate transfer member 40 may not be moved to the sheet material in the secondary transfer process, and a remainder of the secondary transfer corresponding to a few percent of the toner image typically occurs. The two types of unnecessary toner images are recovered by the intermediate transfer member cleaning blade 46 and the developer recovery section 47 disposed so as to have contact with the intermediate transfer member 40 in order for forming the subsequent image. In such a case in which the transfer is not performed, such a bias voltage as to press the residual toner on the intermediate transfer member 40 against the intermediate transfer member 40 is applied to the secondary transfer roller 61.

Figure 7:
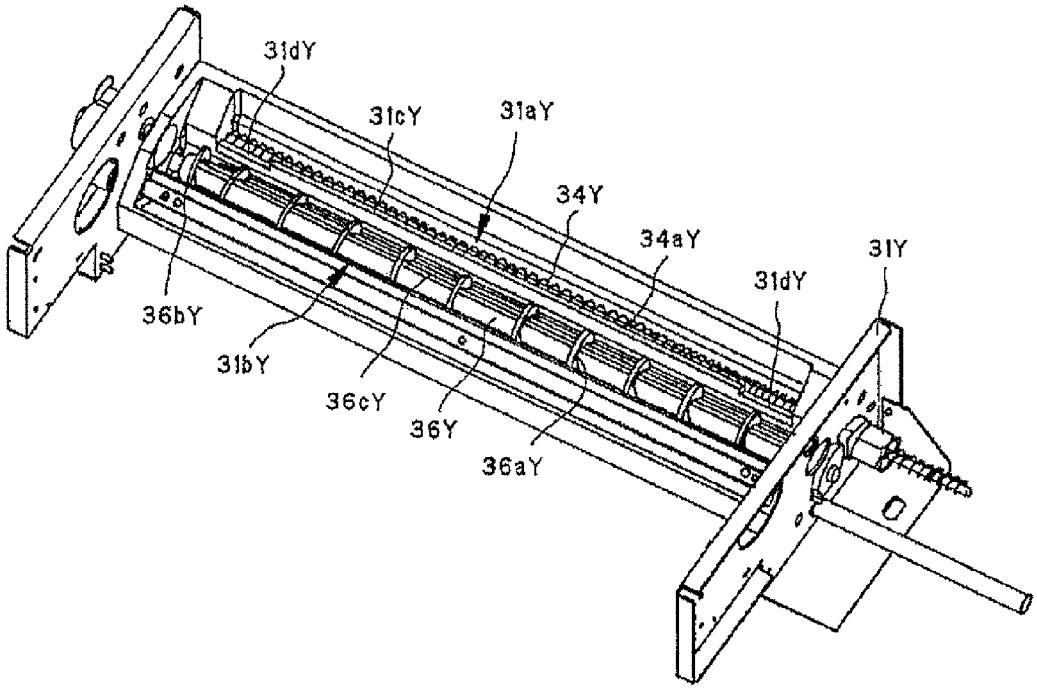
FIG. 7 is a perspective view of a developer container provided with a recovery screw and an agitating paddle.
Figure 8:
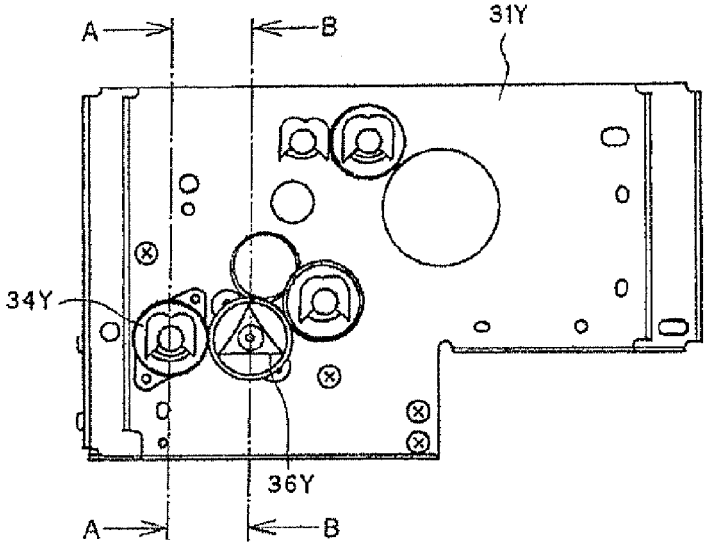
FIG. 8 is a plan view of the developer container shown in FIG. 7.
Figure 9:
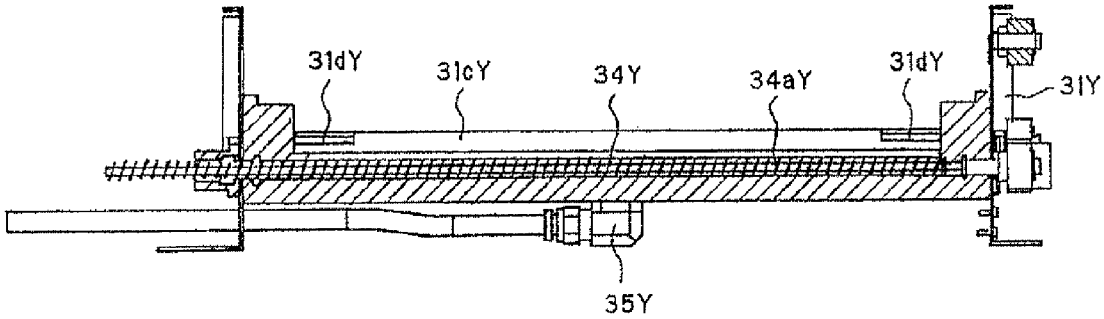
FIG. 9 is a cross-sectional view along line A-A of FIG. 8.
Figure 10:
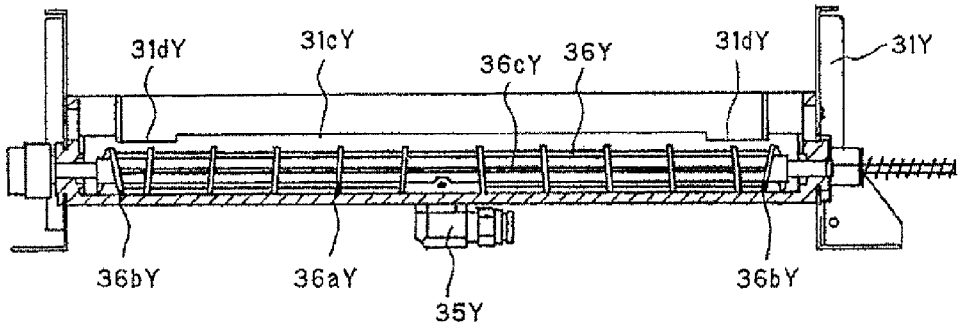
FIG. 10 is a cross-sectional view along line B-B of FIG. 8.

The structures of the developer container 31Y, the recovery screw 34Y, the communication section 35Y, the agitating paddle 36Y, are now explained. FIG. 7 is a perspective view of the developer container 31Y provided with the recovery screw 34Y and the agitating paddle 36Y, FIG. 8 is a side view of the developer container 31Y shown in FIG. 7, FIG. 9 is a cross-sectional view along line A-A of FIG. 8, and FIG. 10 is a cross-sectional view along line B-B of FIG. 8.

The developer container 31Y has a recovery section 31*a*Y and a supply section 31*b*Y. On the boundary between the recovery section 31*a*Y and the supply section 31*b*Y, a wall-like partition 31*c*Y is provided as a partitioning member, and the partition 31*c*Y is provided with notch sections 31*d*Y. The notch sections 31*d*Y are preferably disposed in the vicinities of the both ends of the partition 31*c*Y in the axis direction.

By providing the notch sections 31*d*Y to the partition 31*c*Y, it is possible to allow liquid developer to overflow to the recovery section 31*a*Y side when liquid developer in the supply section 31*b*Y is increased. Thus, the amount of liquid in the supply section 31*b*Y can be kept constant, thereby keeping the amount of liquid developer to be supplied to the developer supply roller 32Y constant and stabilizing the image quality.

The recovery section 31*a*Y is formed of a concave-shaped part provided with the recovery screw 34Y, and is for transporting the liquid developer to the liquid developer reservoir 71Y via the development unit recovery path 72Y. The recovery screw 34Y is formed of a cylindrical member, is provided with a spiral recovery rib 34*a*Y on the outer periphery thereof, and is configured to make recovered liquid developer flow towards the development unit recovery path 72Y.

The supply section 31*b*Y is formed of a concave-shaped part communicated with the communication section 35Y and provided with the agitating paddle 36Y, to which liquid developer is supplied from the liquid developer reservoir 71Y via the developer supply path 81Y, the developer supply pump 82Y, and the communication section 35Y.

The communication section 35Y is a part disposed at roughly the center on the agitating puddle 36Y in the direction of the rotational center axis, slightly shifted from the point right under the axis towards the downstream side in the rotational direction of the agitating paddle 36Y, communicated with the developer supply path 81Y, and for drawing the liquid developer from the liquid developer reservoir 71Y by the developer supply pump 82Y.

By providing the communication section 35Y under the agitating paddle 36Y, the liquid developer supplied from the communication section 35Y is blocked by the agitating paddle 36Y. Thus, a rise in the upper surface of the liquid caused by blowing up of the liquid developer is prevented. Therefore, the upper surface of the liquid is kept substantially constant, and the developer can thereby be stably supplied to the developer supply roller 32Y. Further, by disposing the communication section 35Y at a position slightly shifted from a position right under the center of the agitating paddle 36Y towards the downstream side in the rotational direction of the agitating paddle 36Y, negative pressure is applied to the communication section 35Y to automatically suction the liquid developer. Thus, the transportation capacity of the developer supply pump 82Y is reduced, and consequently, cost and noise are also reduced. Further, since it is possible to dispose the communication section 35Y at roughly the center thereof in the axial direction and the notch sections 31*d*Y in the vicinities of the both ends thereof in the axis direction, the liquid developer is caused to flow outward in the axis direction. Thus, fresh liquid developer can always be supplied to the developer supply roller 32Y.

The agitating paddle 36Y is formed of a cylindrical member, provided with a first rib 36*a*Y with a spiral shape as a flow rib for making liquid developer flow towards both ends thereof in the axial direction formed on the outer periphery of the cylindrical member in the intermediate area in the axial direction thereof, and further provided with second ribs 36*b*Y each having a spiral shape as a flow rib for making liquid developer flow from the end thereof in the axial direction towards the center thereof in the axial direction formed on the outer periphery of the cylindrical member in the respective end areas in the axial direction thereof. The boundaries between the first rib 36*a*Y and the second ribs 36*b*Y are preferably located in the vicinities of the notch sections 31*d*Y. Further, the agitating paddle 36Y is provided with third ribs 36*c*Y as a plurality of supply ribs for supplying the developer supply roller 32Y with the liquid developer disposed on the outer periphery of the cylindrical member in the axial direction thereof so as to be lower than the first rib 36*a*Y and the second ribs 36*b*Y.

By thus providing the first rib 36*a*Y to the agitating paddle 36Y, liquid developer supplied from the communication section 35Y at the center thereof in the axial direction is apt to flow towards both ends. By providing the second ribs 36*b*Y to the agitating paddle 36Y, it is possible to make liquid developer stably overflow from the notch sections 31*d*Y to the recovery section 31*a*Y, thus preventing liquid developer from being reserved and compressed on both ends of the supply section 31*b*Y in the axial direction thereof. By providing the third ribs 36*c*Y, liquid developer is easily transported in the rotational direction, thus making it possible to stably supply the developer supply roller 32Y with the liquid developer.

The agitating paddle 36Y rotates in the same direction as the rotational direction of the developer supply roller 32Y, and the rotational center of the agitating paddle 36Y is located at a position slightly shifted from a position right under the rotational center of the developer supply roller 32Y towards the upstream side in the rotational direction of the developer supply roller 32Y.

As described above, by disposing the rotational center of the agitating paddle 36Y at a position slightly shifted from a position right under the rotational center of the developer supply roller 32Y towards the upstream side in the rotational direction of the developer supply roller 32Y, the liquid surface raised by rotation of the agitating paddle 36Y is positioned nearer to the limiting blade 33Y, which is downstream of the developer supply roller 32Y, from a line connecting the rotational centers of the developer supply roller 32Y and the agitating paddle 36Y, and consequently, it is possible to stably supply the developer supply roller 32Y with liquid developer.

In liquid developer image forming devices using developer having toner dispersed in carrier liquid, a developer having approximately 25 weight percent toner dispersed in 75 weight percent carrier liquid is used, and in the stage in which an image has been formed through various process steps and is secondary-transferred to sheet material as a final stage, and proceeds to a fixing step, not shown, the liquid developer is preferably in a dispersion state of 40-60 toner weight percent in order to exert a preferable secondary transfer function and a preferable fixing function. Although the developer initially reserved in the developer container 31Y is in a state of dispersing approximately 25 weight percent toner in carrier liquid, when an image with a high duty ratio has been developed on the image supporting member 10Y, the consumption ratio of the toner component rises. On the contrary, for an image with a low duty ratio, the consumption ratio of the toner component decreases. In other words, the toner weight percent of the developer reserved in the liquid developer reservoir 71Y is varied momentarily in accordance with the development of images on the image supporting member 10Y, and therefore, it is desirable to constantly watch the variation to control the dispersion state to be kept at approximately 25 toner weight percent.

Therefore, the liquid developer reservoir 71Y is preferably provided with a transmissive photo sensor for detecting the dispersion weight percentage of the toner or a torque detector for detecting the agitating torque for agitating the developer and a reflective photo sensor for detecting the surface level of the liquid developer in the liquid developer reservoir 71Y, all of which are not shown in the drawings, and when the dispersion weight percentage of the toner is decreased, a predetermined amount of developer having high concentration of 35-55 weight percent toner dispersed therein is supplied from a developer cartridge. On the contrary, when the dispersion weight percentage of the toner is increased, a predetermined amount of carrier liquid is supplied from a carrier liquid cartridge, thereby controlling the toner weight percentage to be approximately 25%, and at the same time, agitating the developer in the liquid developer reservoir 71Y to be in a uniform dispersion state.

Figure 11:
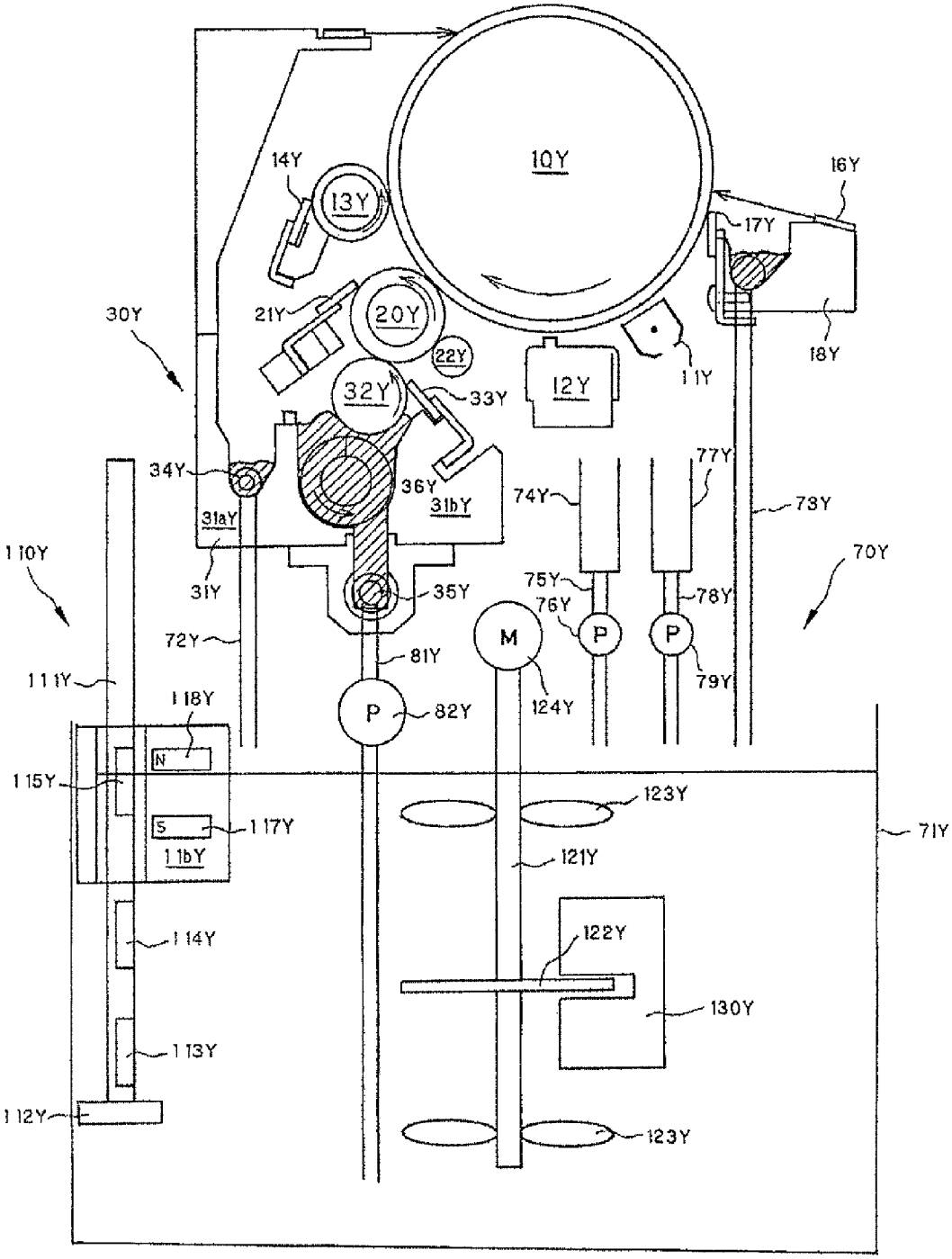
FIG. 11 is a diagram showing a liquid level detector and a concentration detector provided thereto.

For example, as an embodiment of the invention, a liquid level detector 110Y and a concentration detector 120Y are provided as shown in FIG. 11.

The liquid level detector 110Y is first explained. As shown in FIG. 11, the liquid level detector 110Y has a float supporting member 111Y, a limiting member 112Y, a first Hall element 113Y, a second Hall element 114Y, a third Hall element 115Y, a float 116Y as an example of a flotation member, a first magnetic force generation member 117Y, and a second magnetic force generation member 118Y.

The float supporting member 111Y is formed of a member supporting the float 116Y so that the float 116Y can move from the upper surface of the liquid in the liquid developer reservoir 71Y to substantially the bottom thereof under the surface of the liquid, and is provided with an upper limiting member 112*a*Y in an upper part thereof, a lower limiting member 112*b*Y in a lower part thereof, and is further provided with the first Hall element 113Y, the second Hall element 114Y, and the third Hall element 115Y disposed between the upper limiting member 112*a*Y and the lower limiting member 112*b*Y sequentially from the bottom with predetermined intervals.

The first Hall element 113Y, the second Hall element 114Y, and the third Hall element 115Y are each formed of a proportional output Hall element having an output voltage varying in proportion to the magnetic flux density. In the present embodiment, the distance between the Hall elements is assumed to be 30 mm.

The float 116Y is a member floating on the liquid surface, capable of moving with respect to the float supporting member 111Y in accordance with the position of the liquid surface, and is provided with the first magnetic force generation member 117Y disposed in a lower part thereof and the second magnetic force generation member 118Y disposed in an upper part thereof with a predetermined distance from the first magnetic force generation member 117Y.

The first magnetic force generation member 117Y and the second magnetic force generation member 118Y move with respect to the Hall elements 113Y, 114Y, and 115Y in accordance with the movement of the float 116Y. The first magnetic force generation member 117Y and the second magnetic force generation member 118Y are disposed so that the orientations of the N pole and the S pole are reversed to each other. In the present embodiment, the magnetic force generation members 117Y, 118Y are each 5 mm in diameter, 6 mm in length, each generate 4000 Gauss, and are disposed with a distance of 20 mm.

A method of converting the outputs of the respective Hall elements 113Y, 114Y, and 115Y into the distance when the liquid level detector 110Y with such a configuration is actually operated is now explained.

Figure 12C:
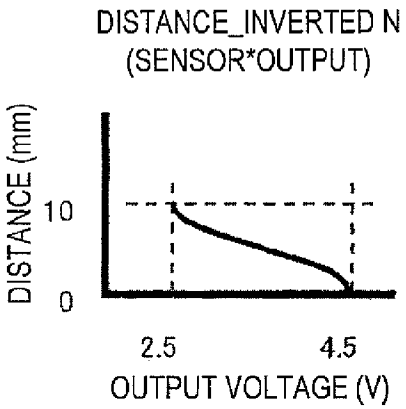
FIGS. 12A-12C are diagrams showing tables for converting the outputs of Hall elements into distances.
Figure 12B:
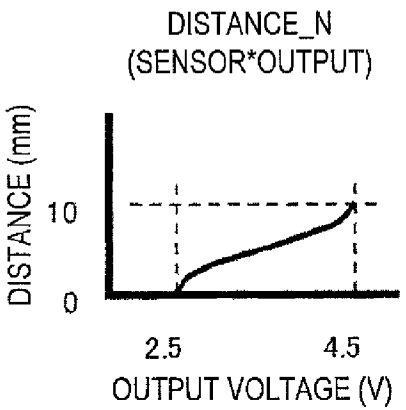
Figure 12A:
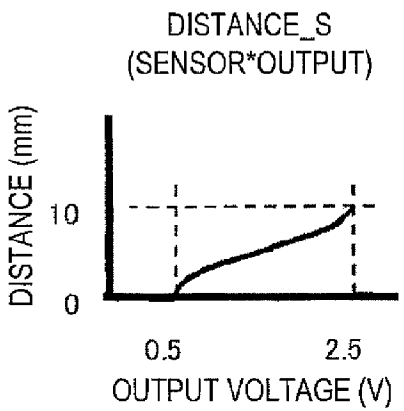

FIGS. 12A-12C are diagrams showing tables for converting the outputs of the Hall elements 113Y, 114Y, and 115Y into the distance. FIG. 12A shows a relationship between the output voltage of each of the Hall elements and the distance in the case of detecting the S pole, FIG. 12B shows a relationship between the output voltage of each of the Hall elements and the distance in the case of detecting the N pole, and FIG. 12C shows a relationship between the output voltage of each of the Hall elements and the distance in the case of detecting the inverted N pole.

Figure 13:
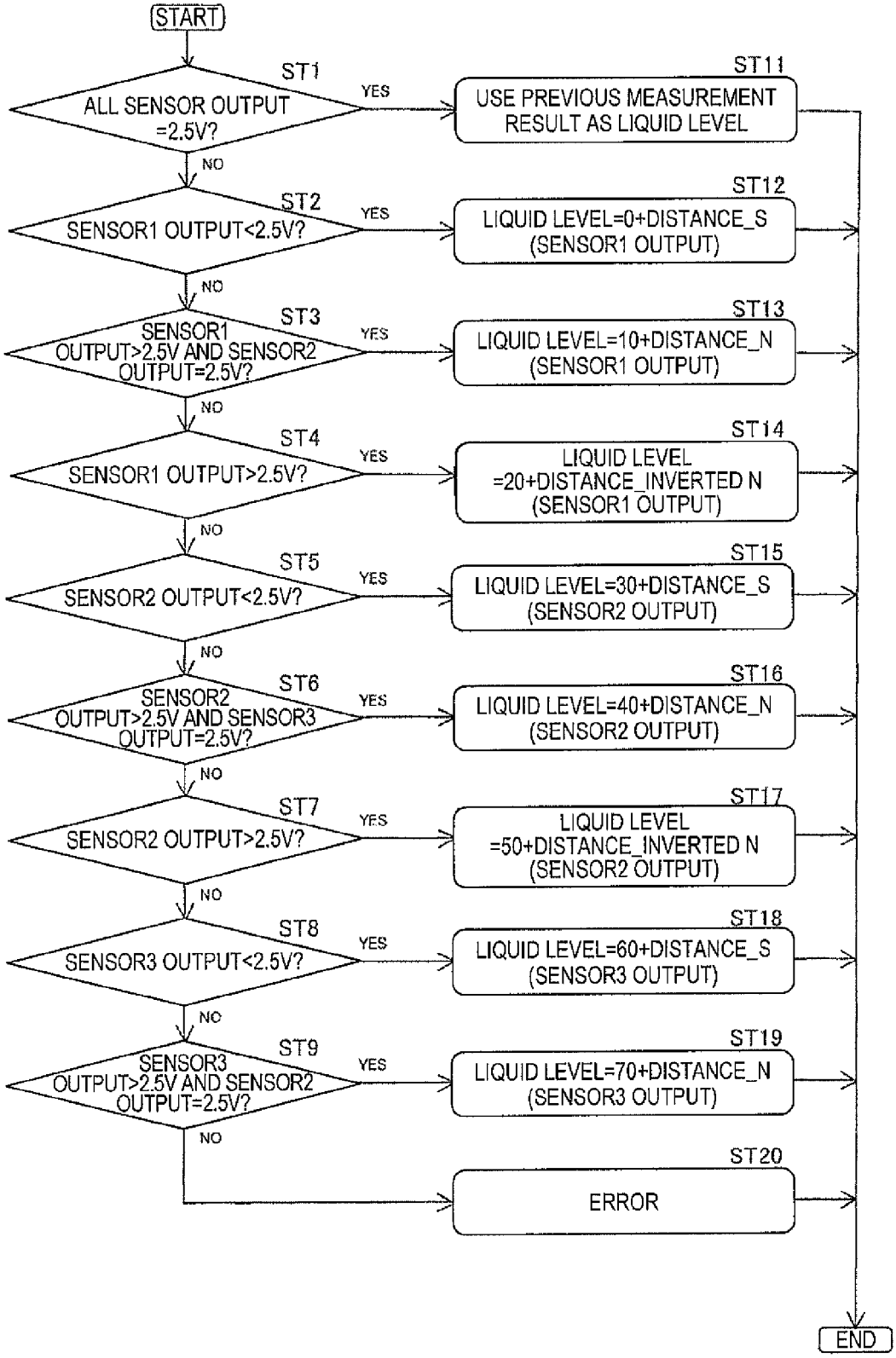
FIG. 13 is a flowchart of a process for converting the outputs of the Hall elements into distances.

FIG. 13 is a flowchart of a process for converting the outputs of the Hall elements 113Y, 114Y, and 1151 into the distance.

Firstly, in step 1, whether or not the outputs of all of the Hall elements 113Y, 114Y, and 115Y are equal to 2.5 V is judged (ST1).

In step 1, if the outputs of all of the Hall elements 113Y, 114Y, and 115Y are equal to 2.5 V, the previous measurement result is used as the liquid level position in step 11 (ST11), and the process is terminated. In step 1, if the outputs of all of the Hall elements 113Y, 114Y, and 115Y are not equal to 2.5 V, whether or not the output of the first Hall element 1131 is lower than 2.5 V is judged in step 2 (ST2).

In step 2, if the output of the first Hall element 113Y is lower than 2.5 V, it is determined in step 12 (ST12) that the liquid level position is the distance obtained from the first table in accordance with the output of the first Hall element 113Y, and the process is terminated. In step 2, if the output of the first Hall element 113Y is higher than 2.5 V, whether or not the output of the first Hall element 113Y is higher than 2.5 V and at the same time the output of the second Hall element 114Y is equal to 2.5 V is judged in step 3 (ST3).

If the conditions in step 3 are satisfied, it is determined in step 13 (ST13) that the liquid level position is a value obtained by adding 10 mm to the distance obtained from the second table in accordance with the output of the first Hall element 113Y, and the process is terminated. If the conditions in step 3 are not satisfied, whether or not the output of the first Hall element 113Y is higher than 2.5 V is judged in step 4 (ST4).

If the condition in step 4 is satisfied, it is determined in step 14 (ST14) that the liquid level position is a value obtained by adding 20 mm to the distance obtained from the third table in accordance with the output of the first Hall element 113Y, and the process is terminated. If the condition in step 4 is not satisfied, whether or not the output of the second Hall element 114Y is lower than 2.5 V is judged in step 5 (ST5).

If the condition in step 5 is satisfied, it is determined in step 15 (ST15) that the liquid level position is a value obtained by adding 30 mm to the distance obtained from the first table in accordance with the output of the second Hall element 114Y, and the process is terminated. If the condition in step 5 is not satisfied, whether or not the output of the second Hall element 114Y is higher than 2.5 V, and at the same time, the output of the third Hall element 115Y is equal to 2.5 V is judged in step 6 (ST6).

If the conditions in step 6 are satisfied, it is determined in step 16 (ST16) that the liquid level position is a value obtained by adding 40 mm to the distance obtained from the second table in accordance with the output of the second Hall element 114Y, and the process is terminated. If the conditions in step 6 are not satisfied, whether or not the output of the second Hall element 114Y is higher than 2.5 V is judged in step 7 (ST7).

If the condition in step 7 is satisfied, it is determined in step 17 (ST17) that the liquid level position is a value obtained by adding 50 mm to the distance obtained from the third table in accordance with the output of the second Hall element 114Y, and the process is terminated. If the condition in step 7 is not satisfied, whether or not the output of the third Hall element 115Y is lower than 2.5 V is judged in step 8 (ST8).

If the condition in step 8 is satisfied, it is determined in step 18 (ST18) that the liquid level position is a value obtained by adding 60 mm to the distance obtained from the first table in accordance with the output of the third Hall element 115Y, and the process is terminated. If the condition in step 8 is not satisfied, whether or not the output of the third Hall element 115Y is higher than 2.5 V, and at the same time, the output of the second Hall element 114Y is equal to 2.5 V is judged in step 9 (ST9).

If the conditions in step 9 are satisfied, it is determined in step 19 (ST19) that the liquid level position is a value obtained by adding 70 mm to the distance obtained from the third table in accordance with the output of the third Hall element 115Y, and the process is terminated. If the conditions in step 9 are not satisfied, it is determined in step 10 (ST10) that an error has occurred, and the process is terminated.

Figure 14:
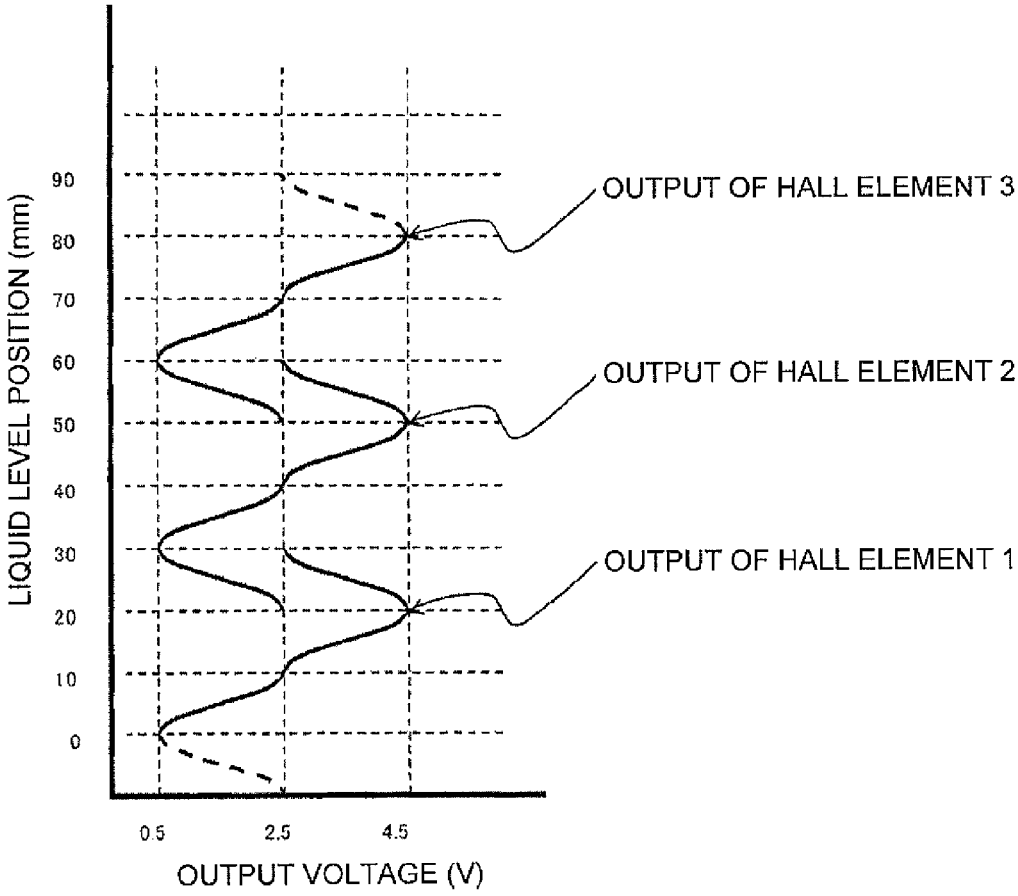
FIG. 14 is a diagram showing a result of executing the process of the flowchart shown in FIG. 13.

FIG. 14 is a diagram showing the result of executing the process of the flowchart shown in FIG. 13. As shown in FIG. 14, the liquid level position corresponding to the output of each of the Hall elements 113Y, 114Y, and 115Y can be obtained.

According to such a liquid level detector 110Y, the number of components is small, thus the cost is reduced, and further, since a long distance is detected, shutdown of the system is prevented.

The concentration detector 120Y is now explained. As shown in FIG. 11, the concentration detector 120Y has an agitating propeller shaft 121Y, a transparent propeller 122Y as an example of a moving member, an agitating propeller 123Y as an example of an agitating member, a motor 124Y, and a concentration measuring section 130Y.

The agitating propeller shaft 121Y is a member provided with the transparent propeller 122Y and the agitating propeller 123Y disposed in a coaxial manner, and rotated by the motor 124Y.

Figure 15:
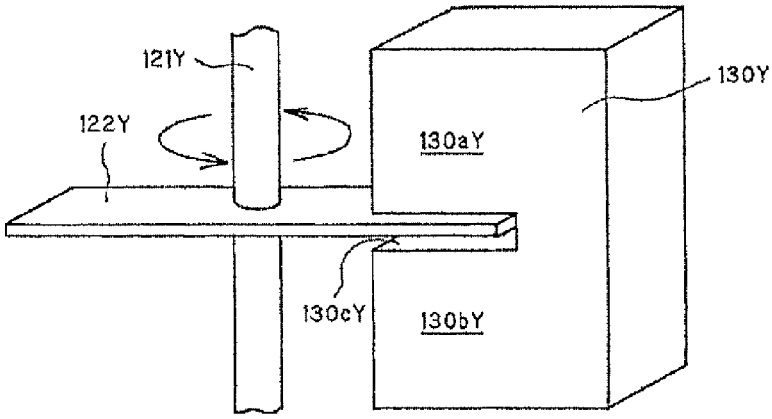
FIG. 15 is an enlarged view of the vicinity of a transparent propeller of FIG. 11.
Figure 16A:
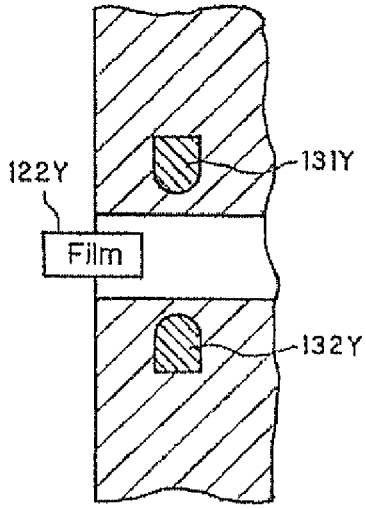
FIGS. 16A and 16B are enlarged views of a gap section thereof.
Figure 16B:
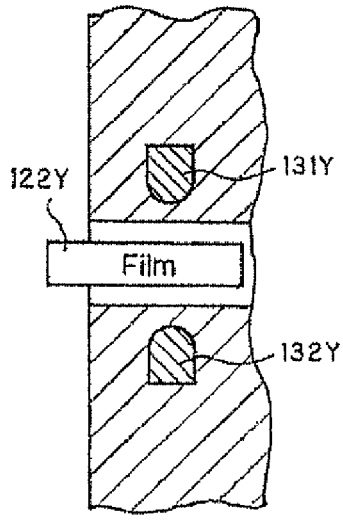
Figure 17:
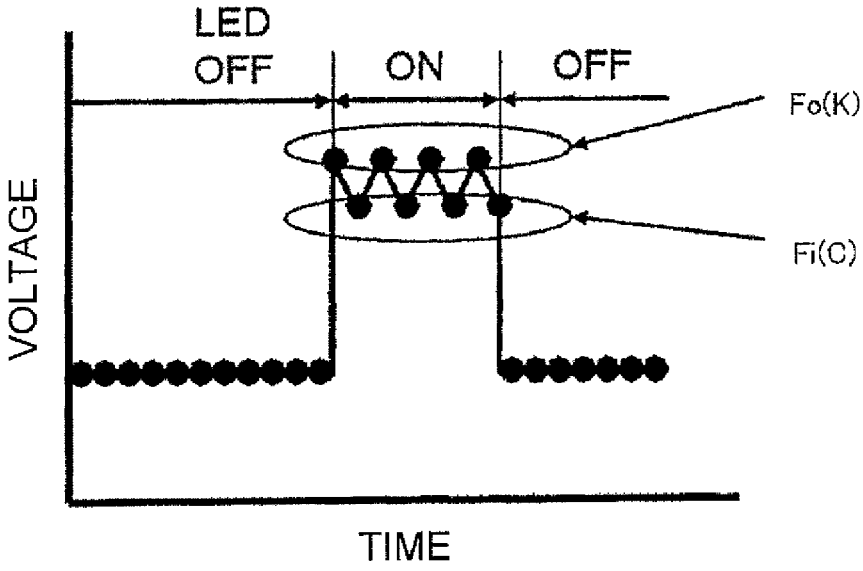
FIG. 17 is a diagram showing transitions of a signal output by a concentration measuring photo acceptance element.
Figure 19:
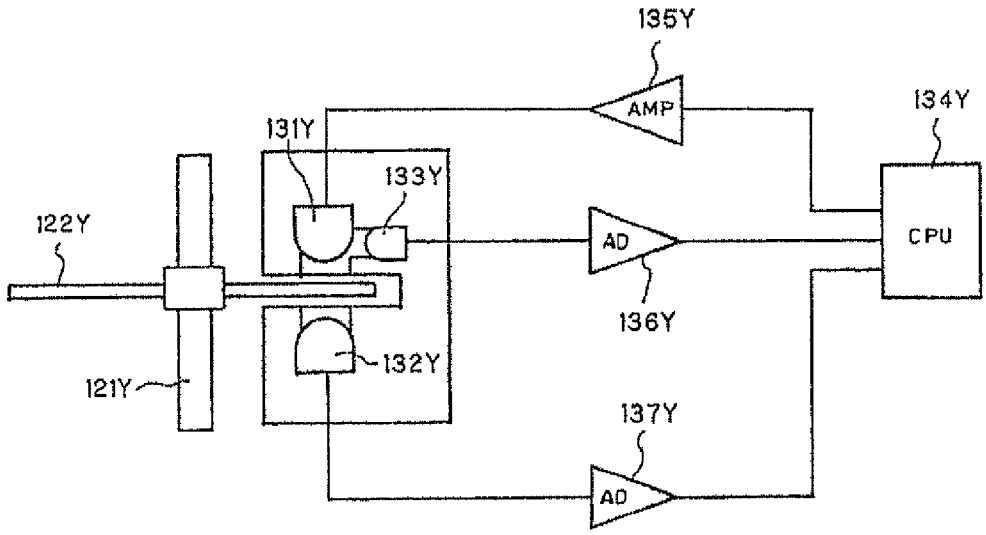
FIG. 19 is a system diagram of a transmissive concentration measuring section.
Figure 20:
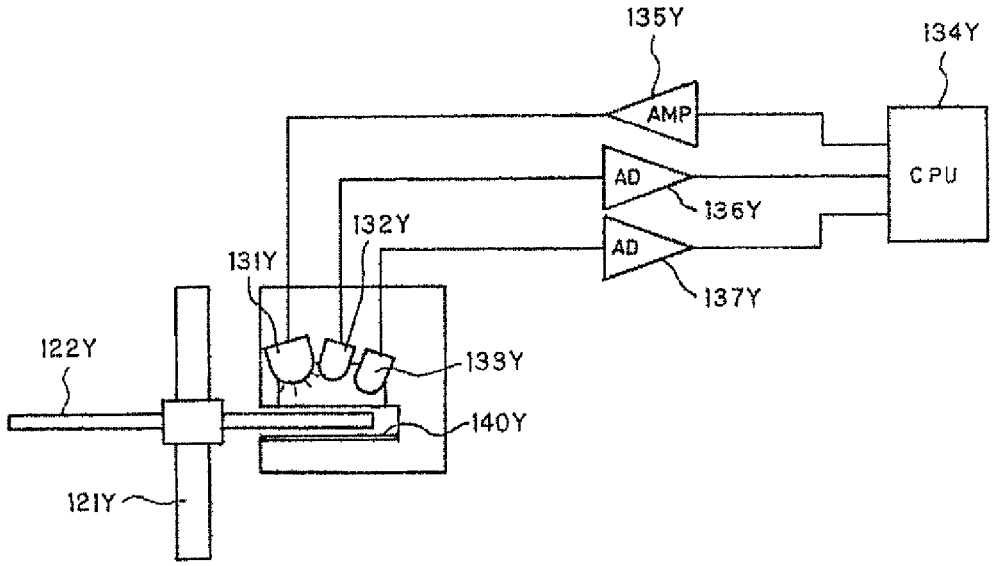
FIG. 20 is a system diagram of a reflective concentration measuring section.

A concentration detection method using the concentration measuring section 130Y and the transparent propeller 122Y is now explained. FIG. 15 is an enlarged view of the vicinity of the transparent propeller 122Y shown in FIG. 11, FIGS. 16A and 16B are enlarged views of a gap section, FIG. 17 is a diagram showing transitions of a signal output by a concentration measuring photo acceptance element 132Y, FIGS. 18A and 18B are graphs showing the relationship between the output voltage of the concentration measuring photo acceptance element 132Y and the concentration of the liquid developer, FIG. 19 is a system diagram of a transmissive concentration measuring section 130Y, and FIG. 20 is a system diagram of a reflective concentration measuring section 130Y.

As shown in FIG. 15, the transparent propeller 122Y is formed of a plate-like member having a rectangular shape and rotatably supported by the agitating propeller shaft 121Y, and has a structure of intermittently passing through a gap 130*c*Y between a first member 130*a*Y and a second member 130*b*Y of the concentration measuring section 130Y. One of the first member 130*a*Y and the second member 130*b*Y is movable, and the distance of the gap 130*c*Y can be changed. The distance of the gap 130*c*Y can be set differently according to the color of the liquid developer.

The principle of the concentration detection method is now briefly explained. FIGS. 16A and 16B are enlarged views of a gap section, and FIG. 17 is a diagram showing transitions in the signal output by the concentration measuring photo acceptance element 132Y. As shown in FIG. 16A, when the transparent propeller 122Y is not located between the LED 131 and the concentration measuring photo acceptance element 132Y, the concentration measuring photo acceptance element 132Y outputs a signal with lower value Fo of the graph shown in FIG. 17. As shown in FIG. 16B, when the transparent propeller 122Y is located between the LED 131 and the concentration measuring photo acceptance element 132Y, the concentration measuring photo acceptance element 132Y outputs a signal with higher value Fi of the graph shown in FIG. 17. In the present embodiment, the value for obtaining the concentration is selected for every color. For example, in the case with black, the values of Fi are averaged to obtain the concentration, and in the case with cyan, the values of Fo are averaged to obtain the concentration.

Figure 18A:
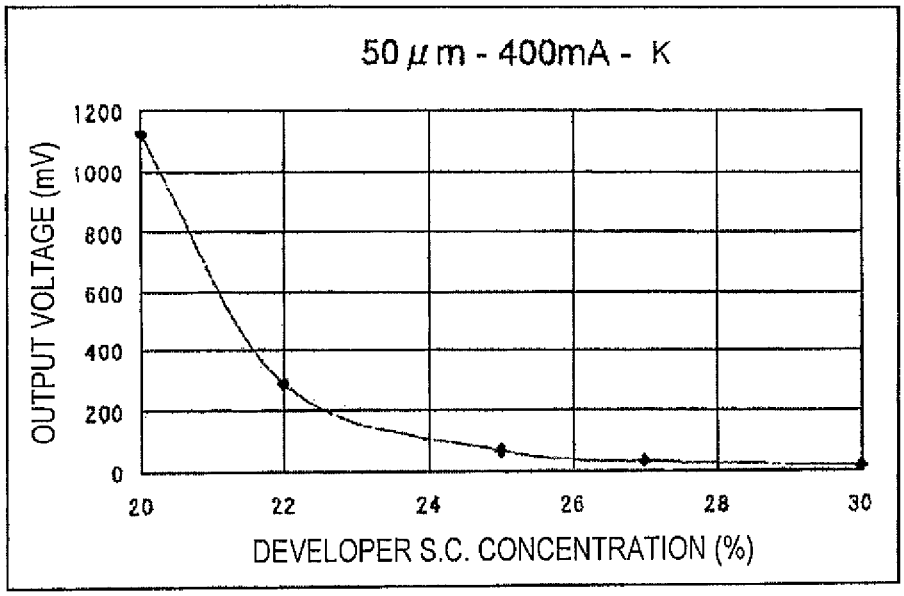
FIGS. 18A and 18B are graphs showing the relationship between the output voltage of the concentration measuring photo acceptance element and the concentration of the liquid developer.
Figure 18B:
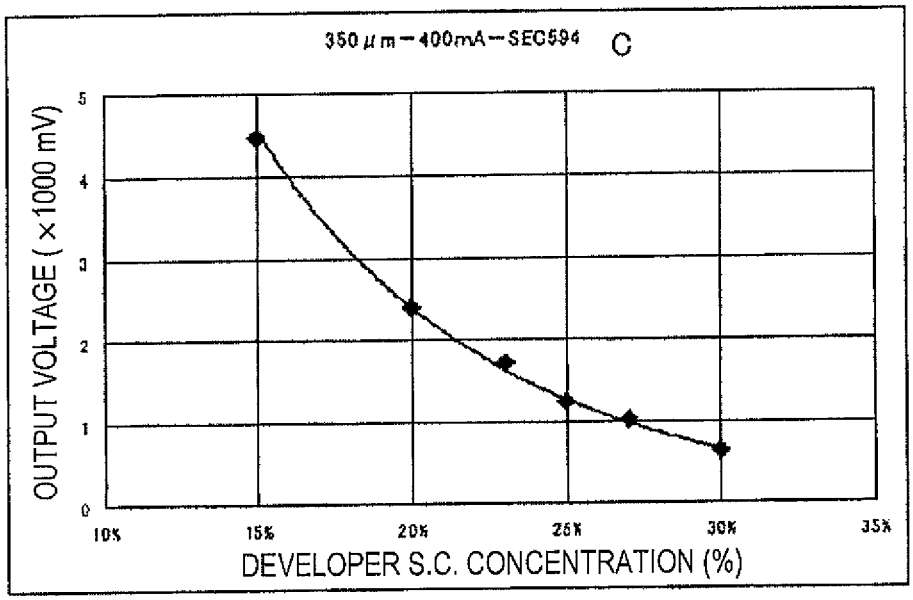

FIGS. 18A and 18B are graphs showing the relationship between the output voltage of the concentration measuring photo acceptance element 132Y and the concentration of the liquid developer. FIG. 18A shows the relationship between the output voltage of the concentration measuring photo acceptance element 132Y and the concentration of the liquid developer for black, and FIG. 18B shows the relationship between the output voltage of the concentration measuring photo acceptance element 132Y and the concentration of the liquid developer for cyan.

In the transmissive type concentration measuring section 130Y as shown in FIG. 19, the LED 131Y and the concentration measuring photo acceptance element 132Y are disposed on the both sides of the gap 130*c*Y so as to be opposed to each other. An emission intensity measuring photo acceptance element 133Y is disposed on the LED 131Y side. According to such a structure, light emitted from the LED 131Y has a light path along which light emitted from the LED 131Y passes through the liquid developer nearer to the LED 131Y than the transparent propeller 122Y, the transparent propeller 122Y, the liquid developer nearer to the concentration measuring photo acceptance element 132Y than the transparent propeller 122Y, and is accepted by the concentration measuring photo acceptance element 132Y, and a light path along which light emitted from the LED 131Y passes through the liquid developer nearer to the LED 131Y than the transparent propeller 122Y and is accepted by the emission intensity measuring photo acceptance element 133Y.

The LED 131Y, the concentration measuring photo acceptance element 132Y, and the emission intensity measuring photo acceptance element 133Y are separately connected to a CPU 134Y. The LED 131Y is connected to the CPU 134Y via an amplifier 135Y, the concentration measuring photo acceptance element 132Y is connected to the CPU 134Y via a first A/D converter 136Y, and the emission intensity measuring photo acceptance element 133Y is connected to the CPU 134Y via a second A/D converter 137Y.

In the reflective type concentration measuring section 130Y as shown in FIG. 20, the LED 131Y, the concentration measuring photo acceptance element 132Y, and the emission intensity measuring photo acceptance element 133Y are disposed on one side of the gap 130*c*Y. A reflecting film 140Y is disposed on the other side of the gap 130*c*Y.

According to such a structure, light emitted from the LED 131Y has a light path along which light emitted from the LED 131Y passes through liquid developer nearer to the LED 131Y than the transparent propeller 122Y, the transparent propeller 122Y, and liquid developer nearer to the reflecting film 140Y, then is reflected by the reflecting film 140Y, further passes through liquid developer nearer to the reflecting film 140Y, the transparent propeller 122Y, and the liquid developer nearer to the concentration measuring photo acceptance element 132Y than the transparent propeller 122Y, and is accepted by the concentration measuring photo acceptance element 132Y, and a light path along which light emitted from the LED 131Y passes through liquid developer nearer to the LED 131Y than the transparent propeller 122Y and is accepted by the emission intensity measuring photo acceptance element 133Y.

The LED 131Y, the concentration measuring photo acceptance element 132Y, and the emission intensity measuring photo acceptance element 133Y are separately connected to the CPU 134Y. The LED 131Y is connected to the CPU 134Y via the amplifier 135Y, the concentration measuring photo acceptance element 132Y is connected to the CPU 134Y via the first A/D converter 136Y, and the emission intensity measuring photo acceptance element 133Y is connected to the CPU 134Y via the second A/D converter 137Y.

As described above, since there is a feature of providing the first member 130*a*Y disposed on one of two sections opposed to each other across the gap 130*c*Y, the second member 130*b*Y disposed on the other of the two sections and opposed to the first member 130*a*Y, the concentration measuring section 130Y disposed on the surface forming the gap 130*c*Y, and the transparent propeller 122Y moving in the gap 130*c*Y, there is no need for drawing up the liquid from the reservoir using a pump or the like, and therefore, the number of components can be reduced. Further, since the transparent propeller 122Y moves in the gap 130*c*Y, the fresh liquid enters the gap 130*c*Y, thus the concentration can accurately be measured.

Further, since there is a feature that the concentration measuring section 130Y has the LED 131Y and the concentration measuring photo acceptance element 132Y, and the transparent propeller 122Y has light permeability, the concentration can accurately be measured.

Further, since there is a feature that the transparent propeller 122Y intermittently passes through the gap 130*c*Y, the measurement can be executed in the case in which the transparent propeller 122Y is located in side the gap 130*c*Y and also in the case in which the transparent propeller 122Y is not located inside the gap 130*c*Y, thus the concentration can further accurately be measured.

Further, since there is a feature that the transparent propeller 122Y is formed of a rotatable substantially rectangular member, the transparent propeller can be moved inside the gap 130*c*Y with a simple structure, thus fresh liquid can enter the gap 130*c*Y, and consequently, the concentration can accurately be measured.

Further, since there is a feature that the agitating propeller 123Y for agitating the liquid is provided, and the transparent propeller 122Y and the agitating propeller 123Y are coaxially disposed, the number of components is reduced.

Further, since there is a feature that one of the first member 130*a*Y and the second member 130*b*Y is movable, and the distance of the gap 130*c*Y can be changed, a measurement corresponding to a type and condition of the liquid can be executed.

Further, since the image forming device using the concentration detector 120Y of the embodiment of the invention has a feature of including a developer container 31Y for reserving a liquid developer having toner particles made of a colorant and resin dispersed in a carrier liquid, a development roller 20Y for supporting the liquid developer, a developer supply roller 32Y for supplying the development roller 20Y with the liquid developer, an agitating paddle 36Y disposed in the developer container 31Y, and for supplying the developer supply roller 32Y with the liquid developer, development roller cleaning member 21Y for removing the liquid developer on the development roller 20Y, an image supporting member 10Y for supporting a latent image to be developed by the development roller 20Y, an intermediate transfer member 40 for forming an image by transferring the image on the image supporting member 10Y, a developer recovery/supply device 70Y for recovering the liquid developer from the developer container 31Y, and supplying the liquid developer and the carrier liquid, and a concentration detector, it is possible to accurately control the liquid developer to have a desired concentration, thus the image can be formed with preferable image quality.

Further, since there is a feature of varying the distance of the gap 130*c*Y according to the color of the liquid developer, the concentration can accurately be controlled for every color.

Figure 21:
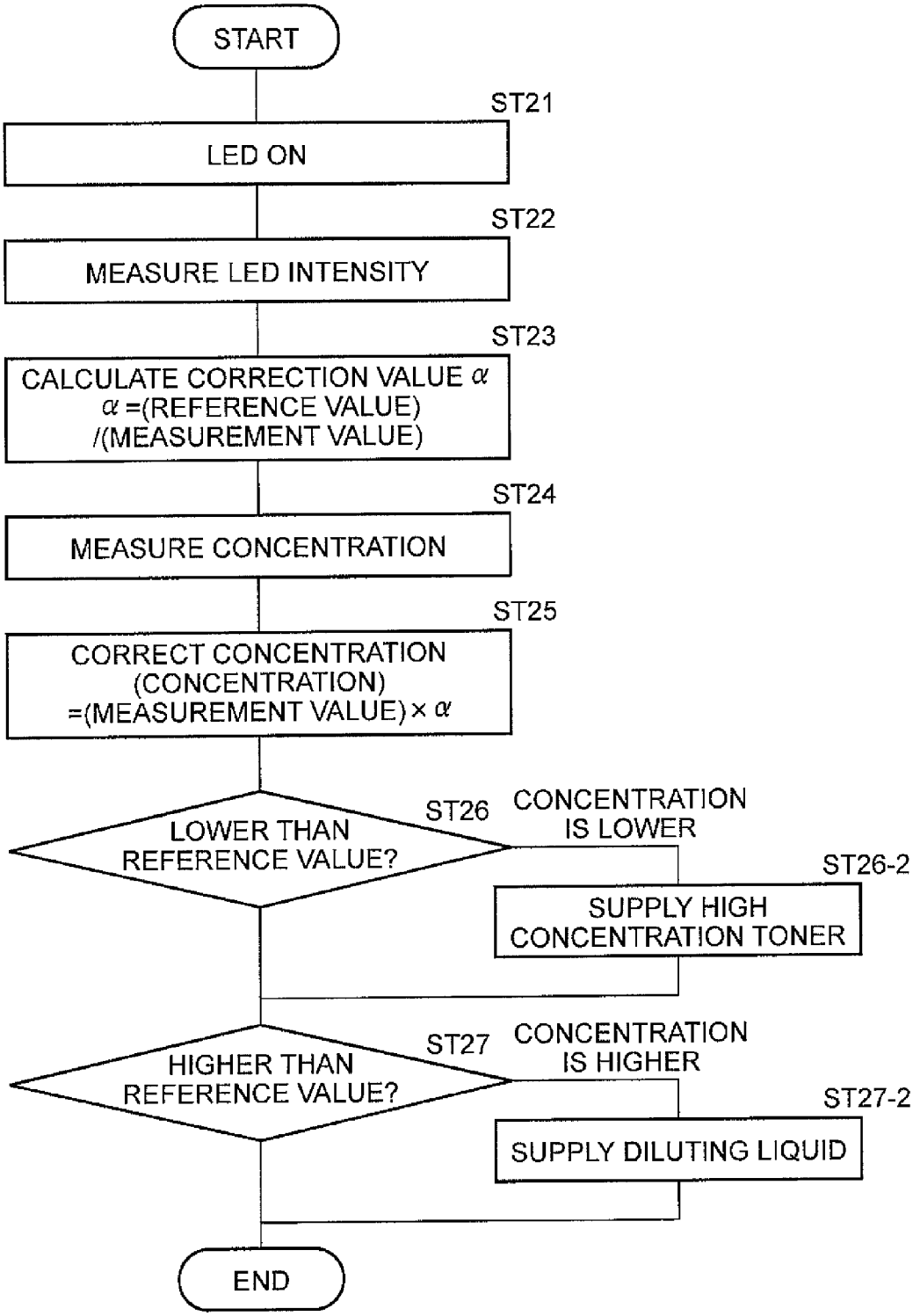
FIG. 21 is a diagram showing a flowchart of a detection process of the concentration detector.

A detection method of the concentration detector 120Y having a configuration as described above is now explained. FIG. 21 is a diagram showing a flowchart of a detection process of the concentration detector 120Y.

The LED 131Y is first switched on in step 21 (ST21). In step 22, the intensity of the LED 131Y is then measured by the emission intensity measuring photo acceptance element 133Y (ST22).

In step 23, a correction value $\alpha$ is then calculated (ST23). The correction value $\alpha$ can be obtained by comparing a reference value of the LED 131Y stored previously with the measurement value measured by the emission intensity measuring photo acceptance element 133Y.

In step 24, the concentration is then measured using the concentration measuring photo acceptance element 132Y (ST24).

In step 25, the CPU 134Y then executes the concentration correction to obtain the concentration of the liquid developer (ST25). The concentration of the liquid developer can be obtained as the product of the measurement value obtained by the concentration measuring photo acceptance element 132Y in step 24 and the correction value $\alpha$ obtained in step 23.

In step 26, whether or not the concentration of the liquid developer is lower than a concentration reference value stored previously (ST26) is determined. If the concentration is lower, the high concentration developer is supplied to the liquid developer reservoir 71Y from the developer tank 74Y via the developer supply path 75Y and the developer pump 76Y in the step 26-2 (ST26-2).

If the concentration is not lower, whether or not the concentration of the liquid developer is higher than the concentration reference value stored previously is judged in step 27 (ST27). If the concentration is higher, the carrier liquid is supplied to the liquid developer reservoir 71Y from the carrier liquid tank 77Y via the carrier liquid supply path 78Y and the carrier liquid pump 79Y in the step 27-2 (ST27-2).

By thus controlling, the concentration of the liquid developer in the liquid developer reservoir 71Y becomes substantially constant.

Control of the developer pump 76Y and the carrier pump 79Y is now explained. The controlled variables of the developer pump 76 Y or the carrier pump 79Y are controlled in accordance with the underrun of the amount of the toner or the amount of the carrier liquid.

The amount of toner and the amount of carrier liquid in the liquid developer is first obtained using the liquid level detector 110Y and the concentration detector 120Y shown in FIG. 11. Then, the underrun of each of the amount of toner and the amount of carrier liquid of the liquid developer with respect to the target values thereof stored previously is calculated.

Figure 22:
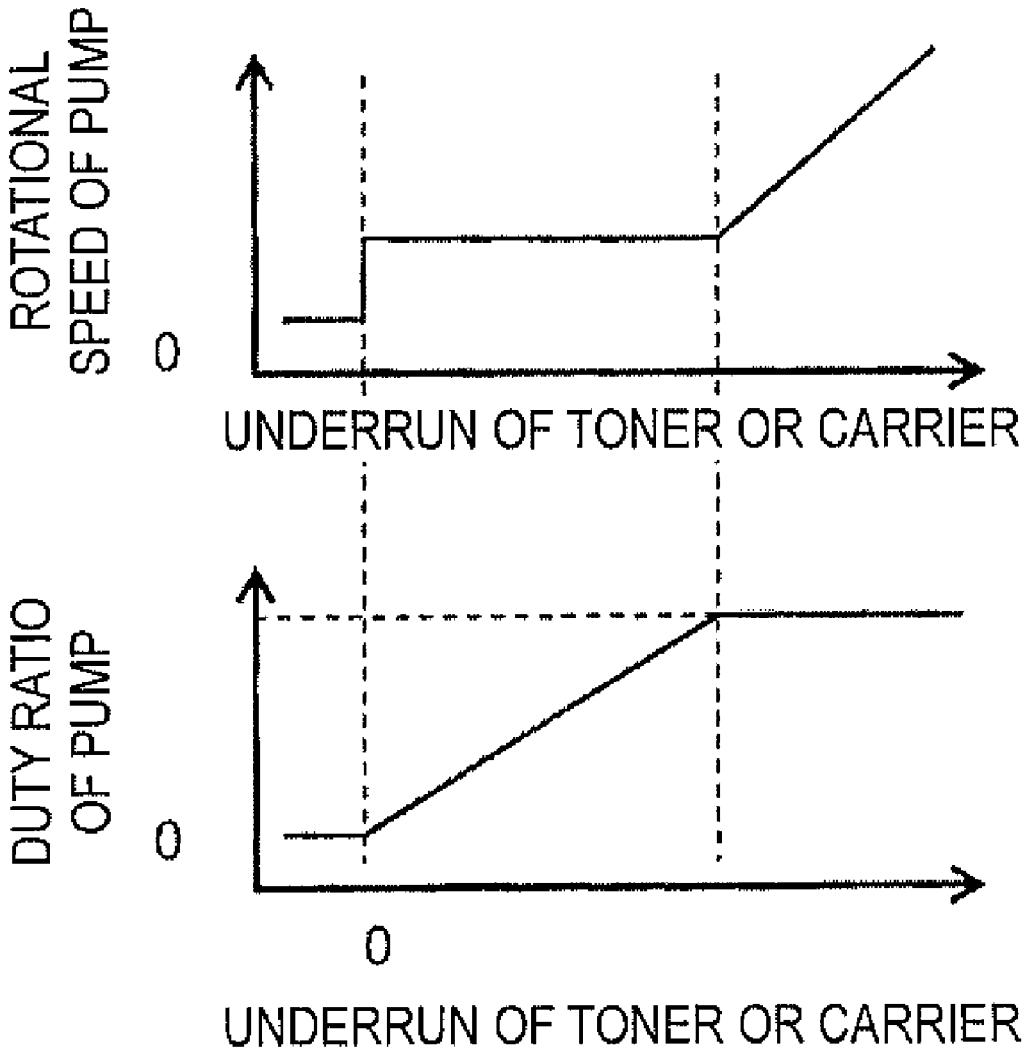
FIG. 22 is a diagram showing the rotational speed and the duty value of a developer pump and a carrier liquid pump with respect to underrun of an amount of toner or an amount of carrier liquid.

FIG. 22 is a diagram showing the rotational speed and the duty value of a developer pump 76Y and a carrier liquid pump 79Y with respect to the underrun of the amount of toner or the amount of carrier liquid. As shown in FIG. 22, in the developer pump 76Y and the carrier pump 79Y, the rotational speed is kept constant, and the duty ratio is varied until the duty ratio reaches the upper limit value. If the duty ratio reaches the upper limit value, the rotational speed is increased in accordance with the underrun.

Figure 23:
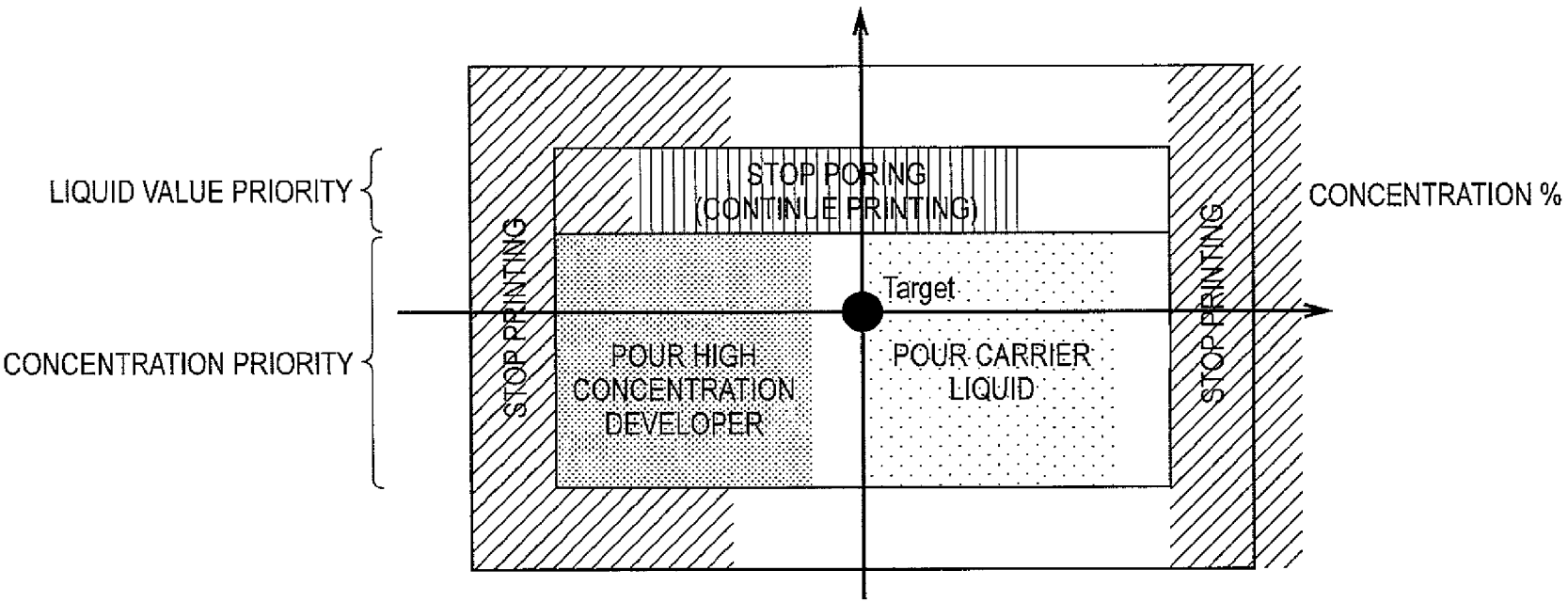
FIG. 23 is a diagram showing priority in controlling the amount and the concentration of liquid developer in a liquid developer reservoir.

Control of the priority in the control operations in the print operation is now explained. FIG. 23 is a diagram showing priority in controlling the amount and the concentration of the liquid developer in a liquid developer reservoir 71Y.

As shown in FIG. 23, priority is given to the concentration in the case in which the amount of liquid is within a certain range, and in the case in which the amount of liquid exceeds the certain range, the amount of liquid takes priority.

For example, priority is given to the concentration until the amount of liquid reaches a certain amount, and if the concentration is higher, carrier liquid is poured in from the carrier liquid tank 77Y to the liquid developer reservoir 71Y. Or if the concentration is lower, high concentration developer is poured in from the developer tank 74Y to the liquid developer reservoir 71Y. In the case of giving priority to the amount of liquid, if the amount of liquid exceeds a threshold, input of carrier liquid and high concentration developer is stopped irrespective of the concentration. It should be noted that the print operation is continued. In the case in which the concentration is out of a certain range, or the amount of liquid is out of a certain range, the print operation is stopped.

The speed of the developer compression roller 22Y and the developer supply roller 32Y may also be controlled in accordance with the detected concentration, thereby controlling the concentration of developer in the development nip.

The developer container 31Y is now explained. In the developer container 31Y according to the embodiment of the invention, the communication section 35Y and the notch sections 31*d*Y are disposed at positions shifted from each other in the axial direction of the agitating member 34Y.

Figure 24:
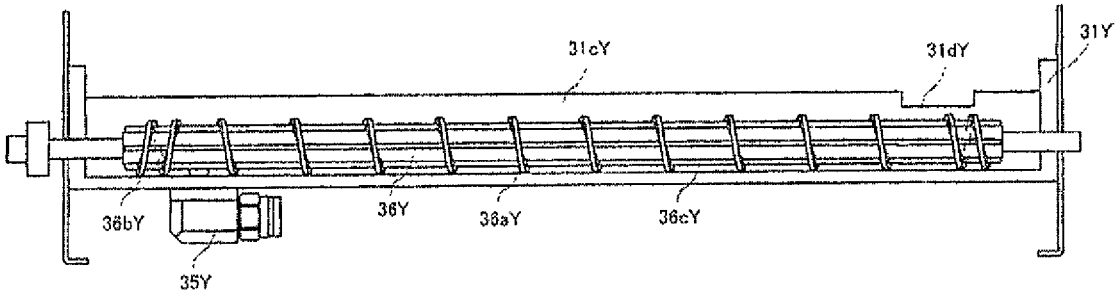
FIG. 24 is a diagram showing a developer container as a second embodiment of the invention.

FIG. 24 is a diagram showing the developer container 31Y according to a second embodiment, and corresponds to FIG. 10 in the first embodiment. In the second embodiment, the communication section 35Y is disposed on a bottom surface of the developer container 31Y at a position on one side thereof in the axial direction, and the notch section 31*d*Y is disposed on the other side thereof in the axial direction.

The agitating paddle 36Y has the first rib 36*a*Y formed so as to make the liquid developer become apt to flow from the communication section 35Y towards the notch section 31*d*Y, and the second rib 36*b*Y formed so as to make the liquid developer become apt to flow from the communication section 35Y towards the opposite side of the notch section 31*d*Y.

By configuring as described above, since liquid developer is supplied into the supply section 31*b*Y via the communication section 35Y, and is made to flow towards the notch section 31*d*Y disposed at a position shifted therefrom in the axial direction, it is possible to make the balance of the amount of liquid developer in the developer container 31Y or the supply section 31*b*Y preferable.

Figure 25:
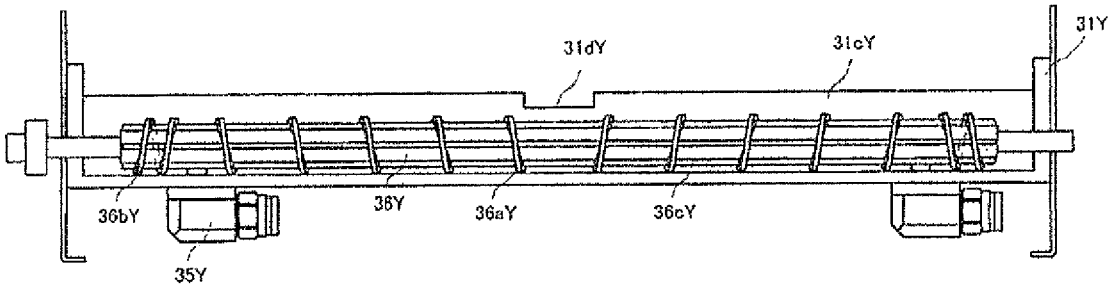
FIG. 25 is a diagram showing a developer container as a third embodiment of the invention.

FIG. 25 is a diagram showing the developer container 31Y according to a third embodiment, and corresponds to FIG. 10 in the first embodiment. In the third embodiment, a first communication section 35*a*Y is disposed on a bottom surface of the developer container 31Y at a position on one side thereof in the axial direction, a second communication section 35*b*Y is disposed on a bottom surface of the developer container 31Y at a position on the other side thereof in the axial direction as the communication sections 35Y, and the notch section 31*d*Y is disposed between the communication sections 35Y in the axial direction.

The agitating paddle 36Y has the first ribs 36*a*Y formed so as to make the liquid developer become apt to flow from the communication sections 35Y towards the notch section 31*d*Y, and the second ribs 36*b*Y formed so as to make the liquid developer become apt to flow from the communication sections 35Y towards the opposite side of the notch section 31*d*Y.

By configuring as described above, since liquid developer is supplied into the supply section 31*b*Y via the communication sections 35Y, and is made to flow towards the notch section 31*d*Y disposed at the position shifted therefrom in the axial direction, it is possible to make the balance of the amount of liquid developer in the developer container 31Y or the supply section 31*b*Y preferable.

Figure 26:
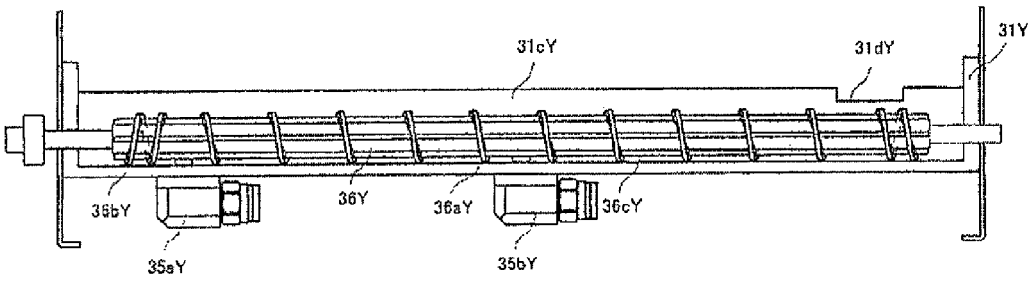
FIG. 26 is a diagram showing a developer container as a fourth embodiment of the invention.

FIG. 26 is a diagram showing the developer container 31Y according to a fourth embodiment, and corresponds to FIG. 10 in the first embodiment. In the fourth embodiment, the first communication section 35*a*Y is disposed on a bottom surface of the developer container 31Y at a position on one side thereof in the axial direction, the notch section 31*d*Y is disposed at a position on the other side thereof in the axial direction, and the second communication section 35*b*Y is disposed on a bottom surface of the developer container 31Y between the first communication section 35*a*Y and the notch section 31*d*Y.

The agitating paddle 36Y has the first rib 36*a*Y formed so as to make the liquid developer become apt to flow from the first communication section 35*a*Y towards the notch section 31*d*Y, and the second rib 36*b*Y formed so as to make the liquid developer become apt to flow from the first communication section 35*a*Y towards the opposite side of the notch section 31*d*Y.

By configuring as described above, since liquid developer is supplied into the supply section 31*b*Y via the communication sections 35Y, and is made flow towards the notch section 31*d*Y disposed at the position shifted therefrom in the axial direction, it is possible to make the balance of the amount of liquid developer in the developer container 31Y or the supply section 31*b*Y preferable.

Figure 27:
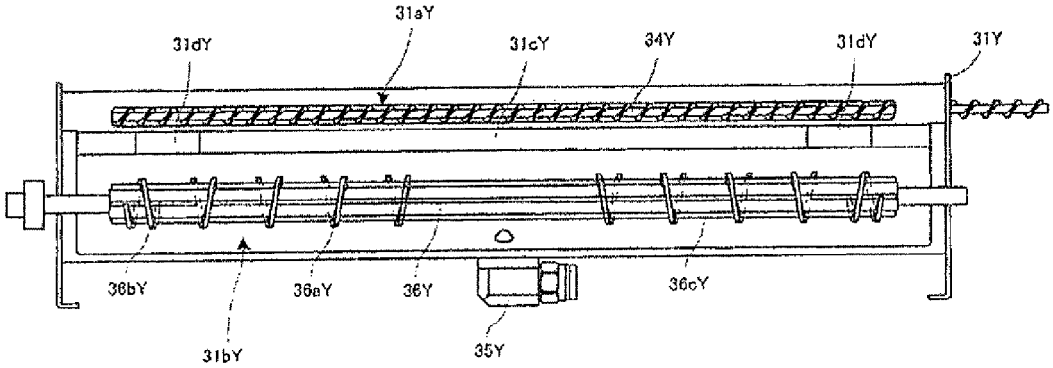
FIG. 27 is a diagram showing a developer container as a fifth embodiment of the invention.
Figure 28:
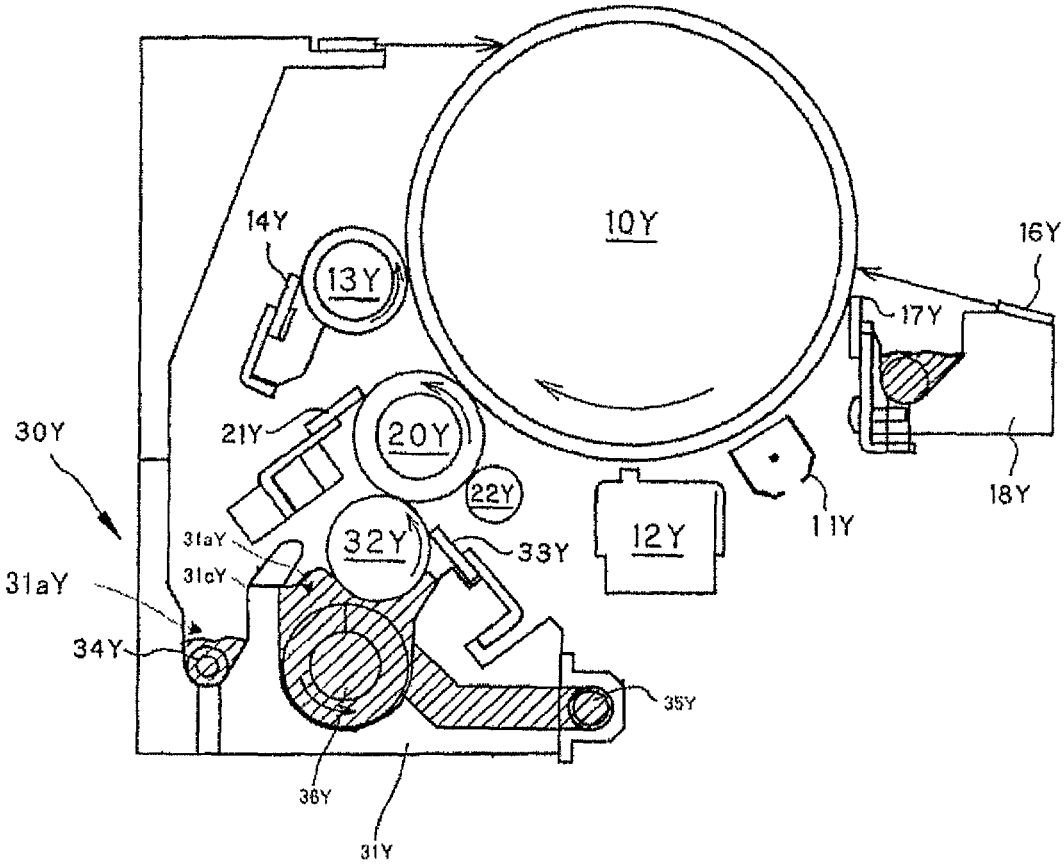
FIG. 28 is a diagram showing a developer container as a fifth embodiment of the invention.

FIGS. 27 and 28 are diagrams showing a fifth embodiment of the invention. FIG. 27 is a plan view of the fifth embodiment, and FIG. 28 is a cross-sectional view of the fifth embodiment. In the fifth embodiment, the communication section 35Y is disposed beside the developer container 31Y and the agitating paddle 36Y.

By providing the communication section 35Y beside the agitating paddle 36Y, liquid developer supplied from the communication section 35Y is blocked by the agitating paddle 36Y. Thus, a rise in the upper surface of the liquid caused by blowing up of the liquid developer can be prevented. Therefore, the upper surface of the liquid is kept substantially constant, and the developer is stably supplied to the developer supply roller 32Y. Further, since it is possible to dispose the communication section 35Y at roughly the center thereof in the axis direction and the notch sections 31*d*Y in the vicinities of both ends thereof in the axis direction, the liquid developer is caused to flow outward in the axis direction. Thus, fresh liquid developer can always be supplied to the developer supply roller 32Y.

In the embodiment of the invention, the supply section 31*b*Y forms a first developer holding section, the recovery section 31*a*Y forms a second developer holding section, and the notch section 31*d*Y forms a flowing section. A structure may also be adopted in which liquid developer recovered by the image supporting member squeezing roller 13Y falls in drops from the image supporting member squeezing roller cleaning blade 14Y into the recovery section 31*b*Y of the developer container 31Y to be recovered. Further, in the embodiment of the invention, the communication section 35Y is preferably disposed on the opposite side of the partition from the plumb line passing through the center of the agitating paddle 36Y. Further, the boundary between the first rib 36*a*Y and the second rib 36*b*Y is preferably at a position corresponding to the plumb line of the notch section 31*d*Y. Further, the first rib 36*a*Y and the second rib 36*b*Y preferably have a semicircular spiral shape. Further, only one agitating paddle 36Y is preferable. Still further, the recovery screw 34Y provided to the recovery section 31*a*Y preferably has double spiral pitches. Further, the partition 31*c*Y is preferably tilted so that the upper part thereof moves towards the supply section 31*b*Y, because this configuration enhances transportation of liquid developer.

As described above, since the development unit 30Y according to the embodiment of the invention includes the developer container 31Y reserving liquid developer containing toner particles and carrier liquid, a developer supporting member 20Y for supporting liquid developer, the developer supply member 32Y for supplying the developer supporting member 20Y with liquid developer, the agitating member 34Y disposed in the developer container 31Y, and for supplying the developer supply member 32Y with liquid developer, and the developer supporting member cleaning member 211 for removing liquid developer from the developer supporting member 20Y, and the developer container 31Y includes the supply section 31*b*Y having the communication section 35Y for making liquid developer flow in, the recovery section 31*a*Y for reserving liquid developer recovered by the developer supporting member cleaning member 21Y, and the partition 31*c*Y for partitioning between the supply section 31*b*Y and the recovery section 31*a*Y, and having the notch section 31*d*Y disposed at a position shifted from the communication section 35Y in the axial direction of the agitating member 34Y for making liquid developer movable between the supply section 31*b*Y and the recovery section 31*a*Y, it is possible to allow liquid developer to overflow to the recovering section 31*a*Y side in the case in which the liquid developer in the supply section 31*b*Y is increased, thus the amount of liquid in the supply section 31*b*Y can be kept constant, thereby keeping the amount of liquid developer to be supplied to the developer supply member 32Y constant, thus it becomes possible to stabilize the image quality. Further, by disposing the notch section 31*d*Y and the communication section 35Y so as to be shifted in the axial direction of the agitating member 34Y, liquid developer supplied via the communication section 35Y moves inside the supply section 31*b*Y, thus the imbalance in the axial direction of the agitating member 34Y is reduced.

Further, since the communication section 35Y is disposed on the bottom surface of the developer container 31Y, the side space can effectively be used.

Further, since the communication section 35Y is disposed on the side surface of the developer container 31Y, the lower space can effectively be used.

Further, since the notch sections 31*d*Y are disposed on both sides of the communication section 35Y in the axial direction of the agitating member 34Y, imbalance in the axial direction of the agitating member 34Y is reduced.

Further, since the communication section 35Y is disposed on one side in the axial direction of the agitating member 34Y, and the notch section 31*d*Y is disposed on the other side in the axial direction of the agitating member 34Y, imbalance in the axial direction of the agitating member 34Y is reduced.

Further, since a plurality of communication sections 35Y is provided, it is possible to sufficiently assure the liquid developer in the supply section 31*b*Y.

Further, since the communication sections 35Y are disposed on both sides of the notch section 31*d*Y in the axial direction of the agitating member 34Y, imbalance in the axial direction of the agitating member 34Y is reduced.

Further, since the communication section 35Y is disposed on the opposite side of the partition 31*c*Y from the plumb plane passing through the rotational center of the agitating member 34Y, the agitating member 34Y exists between the communication section 35Y and the partition 31*c*Y, and it is possible to sufficiently agitate the liquid developer inside the supply section 31*b*Y. Further, since negative pressure is applied to the communication section 35Y, the liquid developer is automatically suctioned, thus the transportation capacity of the developer supply pump 82Y is reduced, thereby reducing cost and noise.

Further, since the agitating member 34Y has the first rib section 36*a*Y for making liquid developer flow from the communication section 35Y towards the notch section 31*d*Y, and the second rib section 36*b*Y different from the first rib section, it is possible to make liquid developer flow smoothly in the supply section 31*b*Y Further, since the boundary between the first rib section 36*a*Y and the second rib section 36*b*Y is disposed at a position corresponding to the notch section 31*d*Y, the liquid developer flows to the vicinity of the notch section 31*d*Y, thus it is easy for liquid developer to flow from the supply section 31*b*Y to the recovery section 31*a*Y Further, since the first rib section 36*a*Y, the second rib section 36*b*Y, or both of the first rib section 36*a*Y and the second rib section 36*b*Y are provided with a semicircular spiral rib, the agitating member 34Y is easily manufactured.

Further, since a single agitating member 34Y is provided, the agitating member can be manufactured at low cost.

Further, since the recovery section 31*a*Y has the transportation member 34Y, and the transportation member 34Y has double spiral pitches, the amount of transportation can be increased.

Further, since the development method according to the embodiment of the invention includes the steps of supplying liquid developer from the communication section 35Y to the supply section 31*b*Y, moving the liquid developer in the axial direction of the agitating member 34Y in the supply section 31*b*Y, making the liquid developer flow from the supply section 31*b*Y to the recovery section 31*a*Y via the notch section 31*d*Y, and reserving liquid developer recovered by the development roller cleaning blade 21Y, it is possible to allow the liquid developer to overflow to the recovering section 31*a*Y side in the case in which the liquid developer in the supply section 31*b*Y is increased, thus the amount of liquid in the supply section 31*b*Y can be kept constant, thereby keeping the amount of liquid developer to be supplied to the developer supply member 32Y constant, thus it becomes possible to stabilize the image quality. Further, by disposing the notch section 31*d*Y and the communication section 35Y so as to be shifted in the axial direction of the agitating member 34Y, liquid developer supplied via the communication section 35Y moves inside the supply section 31*b*Y, thus imbalance in the axial direction of the agitating member 34Y is reduced.

Further, since an image forming device according to the embodiment of the invention includes the image supporting member 10Y for supporting an image developed by the developer supporting member 20Y including toner particles and carrier liquid, an intermediate transfer member 40 to which the image on the image supporting member 10Y is transferred, a developer container 31Y for reserving liquid developer, a developer supporting member 20Y for supporting the liquid developer, the image supporting member 10Y for supporting the image developed by the developer supporting member 20Y, a transfer member 40 for forming an image by transferring the image on the image supporting member 10Y, the developer supply member 32Y for supplying the developer supporting member 20Y with the liquid developer, the agitating member 34Y disposed in the developer container 31Y, and for supplying the developer supply member 32Y with the liquid developer, the developer supporting member cleaning member for removing liquid developer on the developer supporting member 20Y, and a developer recovery/supply device 70Y for recovering liquid developer from the developer container 31Y, and supplying liquid developer and carrier liquid, and the developer container 31Y includes the supply section 31*b*Y to which liquid developer is supplied from the developer recovery/supply device 70Y via the communication section, the recovery section 31*a*Y for transporting liquid developer to the developer recovery/supply device, and the partition 31*c*Y for partitioning between the supply section 31*b*Y and the recovery section 31*a*Y, and having the notch section 31*d*Y disposed at a position shifted from the communication section 35Y in the axial direction of the agitating member 34Y for making the liquid developer movable between the supply section 31*b*Y and the recovery section 31*a*Y, an image can be formed using the liquid developer with stable concentration. Thus, an image with preferable image quality can be formed.

What is claimed is:

1. A development device comprising:

a developer container that reserves a liquid developer containing toner particles and a carrier liquid;

a developer supporting member that supports the liquid developer;

a developer supply roller that supplies the liquid developer from the developer container to the development roller;

a squeezing roller that squeezes an image supporting member; and a squeezing roller cleaning blade that removes the liquid developer on the squeezing roller, wherein the developer container includes:

a first developer holding section having a communication section that makes the liquid developer flow in, a second developer holding section that reserves the liquid developer recovered by the squeezing roller cleaning blade, and a partition wall shared by the first developer holding section and the second developer holding section that partitions between the first developer holding section and the second holding section and that has a flowing section disposed at a position shifted from the communication section in an axial direction of the developer supply roller, wherein the flowing section allows the liquid developer to move from the first developer holding section to the second developer holding section.

2. The development device according to claim 1, further comprising:

a developer supporting member cleaning member that removes the liquid developer on the developer supporting member, wherein the second developer holding section reserves the liquid developer recovered by the developer supporting member cleaning member.

3. The development device according to claim 1, further comprising:

an agitating member that supplies the developer supply roller, wherein the agitating member is disposed in the first developer holding section of the developer container.

4. The development device according to claim 3, wherein the communication section is disposed on a bottom surface of the developer container.

5. The development device according to claim 3, wherein the flowing section is disposed on a side in an axial direction of a rotation of the agitation member.

6. The development device according to claim 1, wherein the flowing section is a notch section of the partition wall.

7. An image forming device comprising:

an image supporting member on which a latent image is formed;

a developer container that reserves a liquid developer containing toner particles and a carrier liquid;

a developer supporting member that supports the liquid developer;

a developer supply roller that supplies the liquid developer from the developer container to the development roller;

a squeezing roller that squeezes the image supporting member; and a squeezing roller cleaning blade that removes the liquid developer on the squeezing roller, wherein the developer container includes:

a first developer holding section having a communication section that makes the liquid developer flow in, a second developer holding section that reserves the liquid developer recovered by the squeezing roller cleaning blade, and a partition wall shared by the first developer holding section and the second developer holding section that partitions between the first developer holding section and the second holding section and that has a flowing section disposed at a position shifted from the communication section in an axial direction of the developer supply roller, wherein the flowing section allows the liquid developer to move from the first developer holding section to the second developer holding section.

8. The image forming device according to claim 7, further comprising:

a liquid developer reservoir that reserves the liquid developer recovered and that concentrates the liquid developer, wherein the communication section flows the liquid developer from a liquid developer reservoir in the first developer holding section of the developer container.

9. The image forming device according to claim 7, wherein the liquid developer reserved in the second developer holding section is transported to the liquid developer reservoir.

* * * * *